US011278169B1

(12) United States Patent
Katsadas et al.

(10) Patent No.: US 11,278,169 B1
(45) Date of Patent: Mar. 22, 2022

(54) FOLDABLE DISPOSABLE TOILET SPLASH GUARD

(71) Applicants: Bill Katsadas, Beaver, PA (US); Kelli Katsadas, Beaver, PA (US)

(72) Inventors: Bill Katsadas, Beaver, PA (US); Kelli Katsadas, Beaver, PA (US)

( * ) Notice: Subject to any disclaimer, the term of this patent is extended or adjusted under 35 U.S.C. 154(b) by 0 days.

(21) Appl. No.: 17/142,755

(22) Filed: Jan. 6, 2021

Related U.S. Application Data

(60) Provisional application No. 62/959,870, filed on Jan. 10, 2020.

(51) Int. Cl.
*A47K 13/24* (2006.01)

(52) U.S. Cl.
CPC ..... *A47K 13/24* (2013.01)

(58) Field of Classification Search
CPC ..... A47K 13/24
USPC ..... 4/300.3, 415, 301, 353, 449, 302; 210/285, 521; 239/461, 518
See application file for complete search history.

(56) References Cited

U.S. PATENT DOCUMENTS 5,855,315 A * 1/1999 Roseth ..... B65D 5/2047 229/120.04
5,953,764 A * 9/1999 Lin ..... A47K 13/16 4/245.4
6,284,359 B1 * 9/2001 Rose ..... C08B 30/12 264/176.1
6,550,075 B1 * 4/2003 Brannon, III ..... A47K 13/24 4/300.3
6,564,398 B1 * 5/2003 Trott ..... E03C 1/186 4/658
6,676,010 B1 * 1/2004 Roseth ..... B65D 5/2057 229/114
7,857,147 B2 * 12/2010 Mulaw ..... A47L 19/04 211/41.3
D655,132 S * 3/2012 Chowning ..... D7/412
8,214,939 B2 * 7/2012 Spurlock ..... E03C 1/181 4/654

(Continued)

OTHER PUBLICATIONS

LOLA Cardboard Applicator Tampon, dated at least as early as Oct. 21, 2019, https://www.mylola.com/products/cardboard-applicator-tampons.

(Continued)

*Primary Examiner* — Lori L Baker
(74) *Attorney, Agent, or Firm* — William F. Lang, IV; Lang Patent Law LLC

(57) ABSTRACT

A foldable splash guard is made from a disposable material, for example, cardboard, or from a flushable material, for example, corn starch. The splash guard can be carried in a flattened or folded configuration, providing for convenience of transporting multiple splash guards so that they are readily available for use. The splash guard is unfolded for use, and placed above a toilet seat or above a bedpan so that urine passing above the seat is redirected back into the toilet bowl, or into a bag for measuring or testing. After use, the splash guard may be discarded. Some examples may include a window with a color changing covering to indicate that urination has occurred, a bag for collecting, measuring, and/or testing urine, or a QR code that can be scanned to facilitate generating rapid, accurate urination records.

15 Claims, 37 Drawing Sheets

(56) References Cited

U.S. PATENT DOCUMENTS

2004/0097893 A1* 5/2004 Elfstrom ..... A61F 5/453 604/358
2005/0251902 A1* 11/2005 Shin ..... A47K 11/12 4/144.1
2008/0251026 A1* 10/2008 Bell ..... A01K 1/0125 119/168
2009/0039144 A1* 2/2009 Hooi ..... B65D 5/248 229/148
2009/0075001 A1 3/2009 O'Neill
2009/0211007 A1* 8/2009 Partridge ..... E03D 9/00 4/300.3
2009/0212593 A1* 8/2009 Larson ..... B60P 3/36 296/158
2009/0320198 A1* 12/2009 Yefremov ..... A47K 13/24 4/300.3
2010/0012043 A1* 1/2010 Wenzel ..... A01K 1/0125 119/165
2010/0077540 A1* 4/2010 Aguila ..... A47K 11/12 4/144.2
2010/0263113 A1* 10/2010 Shelton ..... A61F 5/453 4/144.2
2012/0210502 A1* 8/2012 Baham ..... A61F 5/4556 4/144.3
2012/0312242 A1* 12/2012 Hillman ..... A01K 1/0125 119/169
2013/0000027 A1* 1/2013 San Luis ..... E03D 9/00 4/300.3
2013/0239311 A1* 9/2013 Valenti ..... A61F 5/4556 4/144.3
2013/0305446 A1* 11/2013 Smith ..... A61G 7/0005 4/451
2015/0040303 A1* 2/2015 Uhm ..... E03D 9/00 4/300.3
2015/0223967 A1* 8/2015 Rojals Fort ..... A61F 5/4556 4/144.2
2016/0108609 A1* 4/2016 Escudero ..... A47K 13/24 4/300.3
2016/0369488 A1* 12/2016 Todd, IV ..... E03D 9/00
2017/0174386 A1* 6/2017 Ramos ..... B65D 5/02
2017/0318786 A1* 11/2017 Pinder ..... A01K 23/005
2018/0238034 A1* 8/2018 Gwen ..... E03C 1/30
2019/0308766 A1* 10/2019 Tart ..... B65D 5/606
2019/0358108 A1* 11/2019 Cocks ..... B65D 5/542
2020/0367864 A1* 11/2020 Bajaj ..... A61B 10/007
2021/0169036 A1* 6/2021 Rachel ..... A01K 1/0125
2021/0186786 A1* 6/2021 Webb ..... A61G 9/00
2021/0238838 A1* 8/2021 Crevier ..... E03D 13/005
2021/0274986 A1* 9/2021 Braun ..... A47K 13/24

OTHER PUBLICATIONS

Maddak Toilet Seat Splash Guard, Amazon, https://www.amazon.com/Maddak-Maddaguard-Splash-Guard-Toilet/dp/B003U4TEKU/ref=sr_1_1_sspa? dchild=1&keywords=toilet+splash+guard&qid=1.
The above-listed Maddak Toilet Seat Splash Guard is dated at least as early as Oct. 21, 2019.
Savannah Toilet Splash Guard, Parkgete Mobility, https://www.parkgatemobility.co.uk/toileting-accessories/savanah-toilet-splash-guard/, dated at least as early as Oct. 21, 2019.
Padded Toilet Seat With Splash Guard, Medical Supplies & Equipment Co., https://www.medical-supplies-equipment-company.com/homehealth/product/padded-toilet-seat-with-splash-gu.
Potty Protector, Urinal, Potty Training for Boys, splash guard, little boys, bathroom, toilet, toilet seats, bathroom cleaners, special need, Etsy.
Website for above Etsy Potty Protector: https://www.etsy.com/listing/269014826/potty-protector-urinal-potty-training.
Soft-Flex Commode Splashguard, RehabMart, https://www.rehabmart.com/product/softflex-splashguard-20765.html.
Personal Deflector Toileting Aid, RehabMart, https://www.rehabmart.com/product/personal-deflector-toileting-aid-21687.html.

* cited by examiner

FOLDABLE DISPOSABLE TOILET SPLASH GUARD

CROSS-REFERENCE TO RELATED APPLICATION

This application claims the benefit of U.S. provisional patent application Ser. No. 62/959,870, which was filed on Jan. 10, 2020, and entitled "Foldable Disposable Toilet Splash Guard."

TECHNICAL FIELD

The present invention relates to splash guards to enable males with special needs to utilize a toilet and/or a bed pan while minimizing any risk of urine passing over the top of the toilet or bed pan. More specifically, a foldable, disposable splash guard is provided for use on the front of a toilet seat, or on top of a bedpan.

BACKGROUND INFORMATION

Individuals with special needs sometimes have difficulty ensuring that their urine stream completely enters a toilet. Such individuals may include disabled individuals, elderly individuals, people who have suffered injuries, or other children or adults with various special needs. To assist such individuals, plastic splash guards are placed over the front of a toilet seat. Such splash guards include front and back lower flanges for fitting on either side of a toilet seat, and an upwardly extending shield to catch any stray urine, redirecting the urine back into the toilet. Alternatively, a splash guard may be formed as a part of a toilet seat. Such splash guards are bulky, and require cleaning after use. Some institutions are sufficiently concerned about the possibility of disease being spread by a reusable splash guard that at least one large hospital system refuses to use rigid plastic re-usable splash guards, and instead provides patients with a towel to limit the path of urine when urinating. A splash guard that could be stored and transported in a more compact, perhaps folded or flattened configuration would significantly increase the convenience of carrying such splash guards. A disposable, or perhaps flushable splash guard would simply cleanup after use of the splash guard with a toilet.

U.S. Pat. No. 6,284,359, which was issued to R. R. Rose et al. on Sep. 4, 2001, discloses a biodegradable, water disposable item made from shaped starch. The entire disclosure of this patent is expressly incorporated by reference herein. The starch has a particle size of 400 to 1,500 microns to provide suitable extrusion properties. An alkali metal or alkaline earth salt such as sodium sulfate or sodium chloride may be added as a nucleating agent. The starch may be modified using esterification, etherification, oxidation, or hydrolysis, with etherification with a propylene oxide being a preferred modification. The starch is preferably a high amylose starch. The material is extruded at a temperature of 100° C. to 250° C. The material is described as being formed into a core for a rolled paper product. This patent does not disclose how such material could be utilized to make a splash guard for a toilet.

US 2009/0075001, which was invented by T. O'Neill and published on Mar. 19, 2009, also discloses a flushable toilet paper roll made from corn starch. This application does not disclose how such material could be used to make a splash guard.

Accordingly, there is a need for a toilet splash guard which can be carried in a flattened and/or folded configuration, and which can then be easily placed on a toilet seat for use. There is a further need for a toilet splash guard that can be discarded after use, avoiding any necessity of cleaning the splash guard. There is an additional need for a flushable splash guard, which is water degradable, and which can be flushed down a toilet after use. A splash guard that facilitates the collection of urine for measurement of the quantity of urine or testing of the urine is also needed.

SUMMARY

The above needs are met by a splash guard. The splash guard comprises a shield portion having a back panel, a top panel, and a pair of side panels. Each panel is foldably attached to at least one other panel. The splash guard is foldable into a flattened configuration and into a use configuration.

These and other aspects of the invention will become more apparent through the following description and drawings.

BRIEF DESCRIPTION OF THE DRAWINGS

Like reference characters denote like elements throughout the drawings.

DETAILED DESCRIPTION

Figure 1:
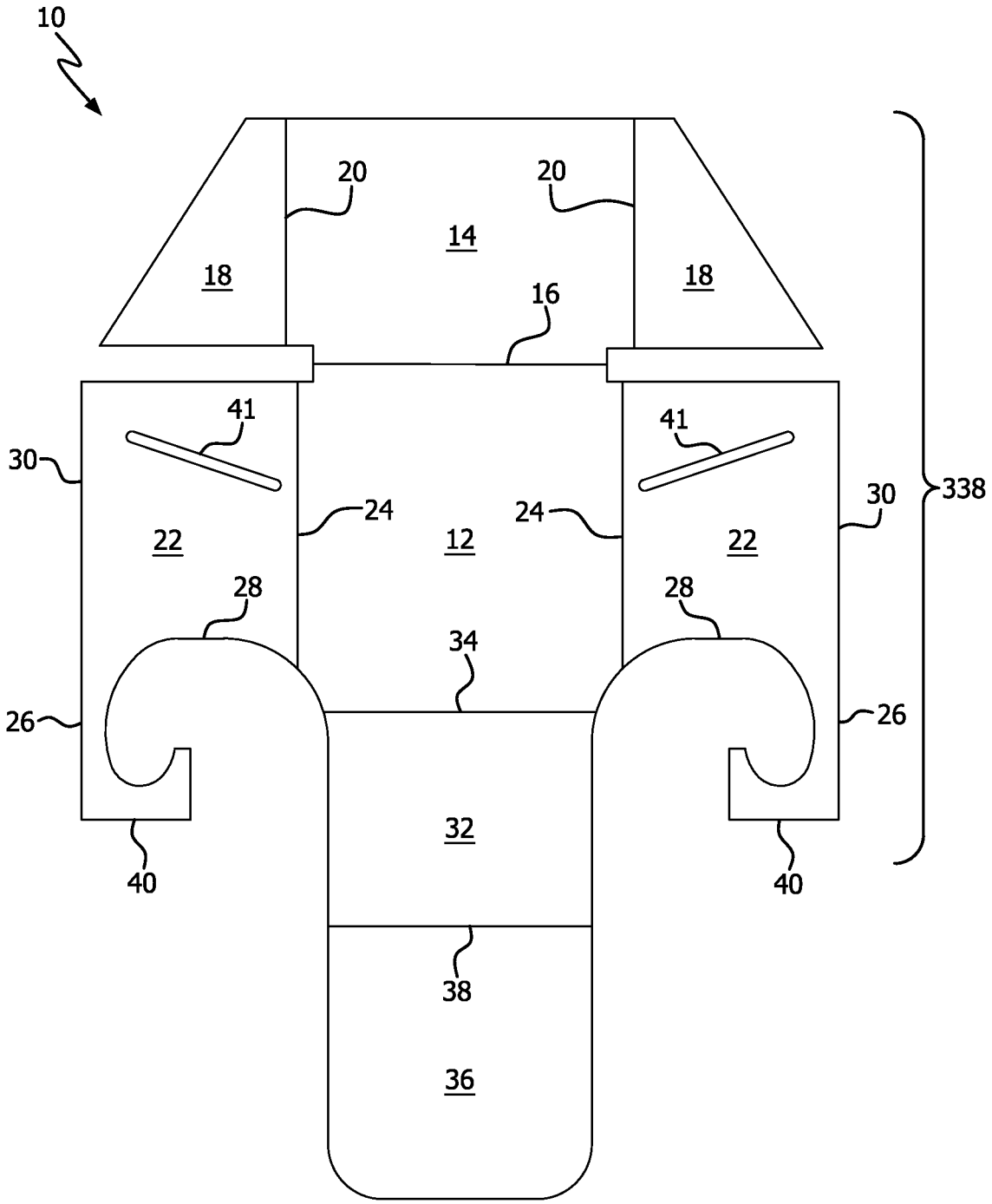
FIG. 1 is a top plan view of a first example of a foldable, disposable splash guard.

Referring to the drawings, various examples of a foldable, disposable splash guard, are shown. Although illustrated in connection with a toilet, a splash guard may also be used in connection with a bedpan. The examples of a splash guard include a shield portion having at least a back, a top, and a pair of sides. Some examples include a pair of legs extend downward from the shield portion, for abutting the inside edge of a toilet seat. Some examples also include a seat flap extending down from the shield portion, and fitting between the toilet seat and bowl. Some examples include a seat guard to protect the portion of the seat below the shield portion, which may take the form of a panel on the shield portion, or an extension of the seat flap. Still other examples may include a window covered with a urine-indicating paper. Further examples may include a urine collection bag.

The foldable, disposable splash guard may be made from any foldable, disposable material having suitable rigidity for installation on a toilet seat. Some examples may be made from cardboard. Many types of food grade cardboard include some water resistance, making these cardboards suitable for impeding a stream of urine. Some examples may include a lacquer applied to one or both surfaces of the splash guard. Other examples may include a film, for example, a flexible polymer film applied to one or both surfaces of the cardboard. Still other examples of the disposable toilet shield can be made from photographic film paper. All of the above examples would be discarded in a trashcan after use. Some examples of the disposable splash guard the be made from a flushable cardboard or paper, for example, a cardboard or paper that is made from corn starch. U.S. Pat. No. 6,284,359, which is described above, discloses a method of making a paper or cardboard item from cornstarch, and the entire disclosure of this patent is expressly incorporated herein by reference. Although many examples of the splash guard can be made from a single piece of material, some examples may require two or more layers of material.

The panels of the splash guard are hingedly or foldably connected to adjacent panels, permitting the splash guard to be folded into a flattened configuration for storage or transportation, and then folded into a use configuration for use on a toilet seat. As used herein, folds, fold lines, hinges, foldably, and hingedly are used interchangeably. Although any paper or cardboard can obviously be folded, a fold, fold line, or a hinge as used herein refers to a predefined line along which the material is folded or along which two adjacent panels move hingedly with respect to each other. Where two panels are described as having a fold line defined between them, or being foldably or hingedly connected together, this description includes the possibility that one of the two panels is adhered or otherwise joined to a third panel, and that the hinge is defined at least partially by that third panel. When "substantially" is used to describe a relationship, for example, two fold lines being substantially parallel, substantially means sufficiently close to accomplish the stated purpose. For example, two fold lines are substantially parallel if they are sufficiently close to parallel to accomplish folding in the described manner. The terms top, bottom, side, etc. are used for convenience of description based on the most common use of the splash guard. Recognizing that rotating the splash guard effectively changes the top, bottom, etc., these terms are not intended to constrain the orientation of the splash guard.

The splash guard may be folded into a flattened configuration for transportation or storage, and a use configuration for placement atop a toilet seat. As used herein, a flattened configuration results when the panels forming the splash guard are positioned so that their flat sides of adjacent panels face each other, and wherein at least a portion of the adjacent flat sides touch each other. The splash guard may also be folded into a use configuration. As used herein, a splash guard is in a use configuration when the back panel, side panels, and top panel are positioned to define a urine-receiving space therewithin, and wherein the splash guard may be positioned on the front of a toilet seat in a self-supporting manner.

Referring to FIGS. 1-4, an example of a foldable splash guard 10 is illustrated. As best shown in FIG. 1, the splash guard 10 can be made from any material meeting the criteria described above, and can be made from a single sheet of such material. The splash guard 10 includes a back panel 12. A top panel 14 is disposed above the back panel 12, with a fold or hinge 16 therebetween. Some examples of the top panel 14 may include side flaps 18 on either side of the top panel 14, with each side flap 18 separated from the top panel 14 by a hinge or fold 20. A pair of side panels 22 extend outward from each side of the back panel 12, with a hinge or fold 24 between the back panel 12 and each side panel 22. A leg 26 extends downward from the bottom edge 28 of each side panel 22, and in the illustrated example is proximate to the forward edge 30 of each side panel 22. Each leg 26 in the illustrated example terminates in a hook 40 that is structured to hook below the inner edge of a toilet seat. A slot 41 is defined within each side panel 22. A seat flap 32 is disposed below the back panel 12, with a fold or hinge 34 defined therebetween. A seat protector 36 extends downward from the seat flap 32, with a hinge or fold 38 therebetween.

Figure 2:
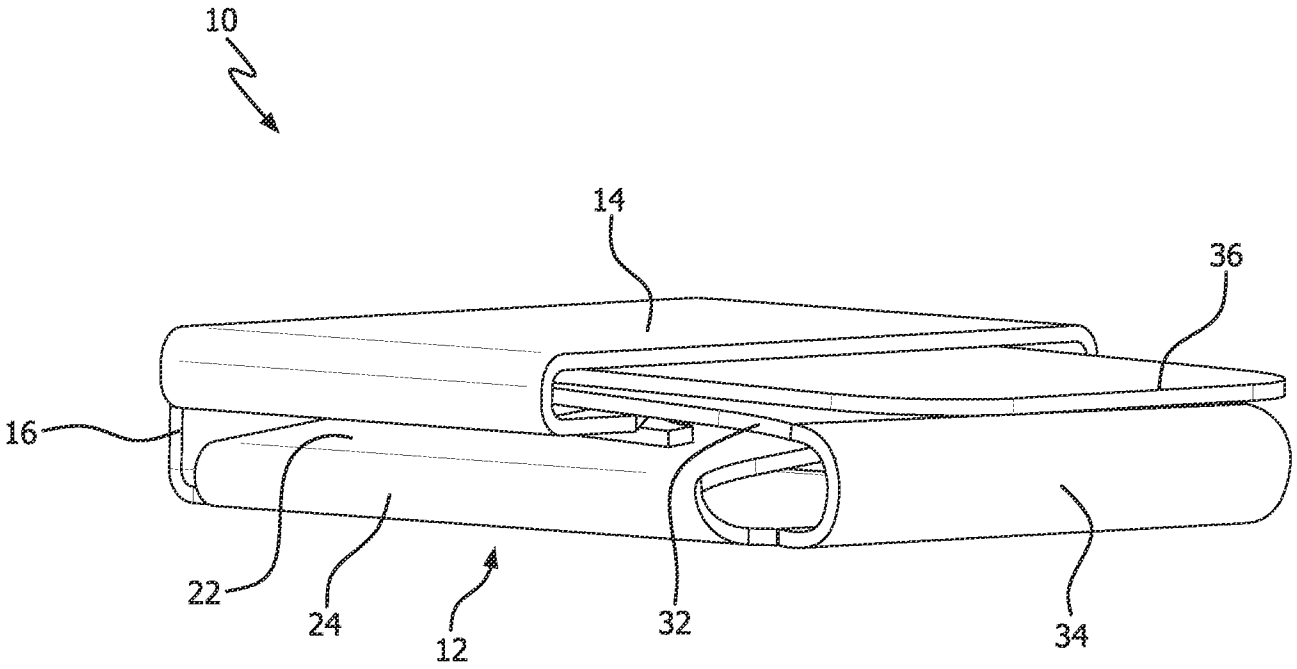
FIG. 2 is a side elevational view of the splash guard of FIG. 1, showing the splash guard folded for storage or transportation.

When the splash guard 10 is being transported or stored, it may be folded along the fold lines into a compact, flattened configuration as illustrated in FIG. 2. Some examples may include an envelope, pouch, or other storage container to hold one or more splash guards 10 in this folded configuration. The splash guard 10 may thereby easily be transported by an individual with special needs, or a caregiver for such an individual.

Figure 3:
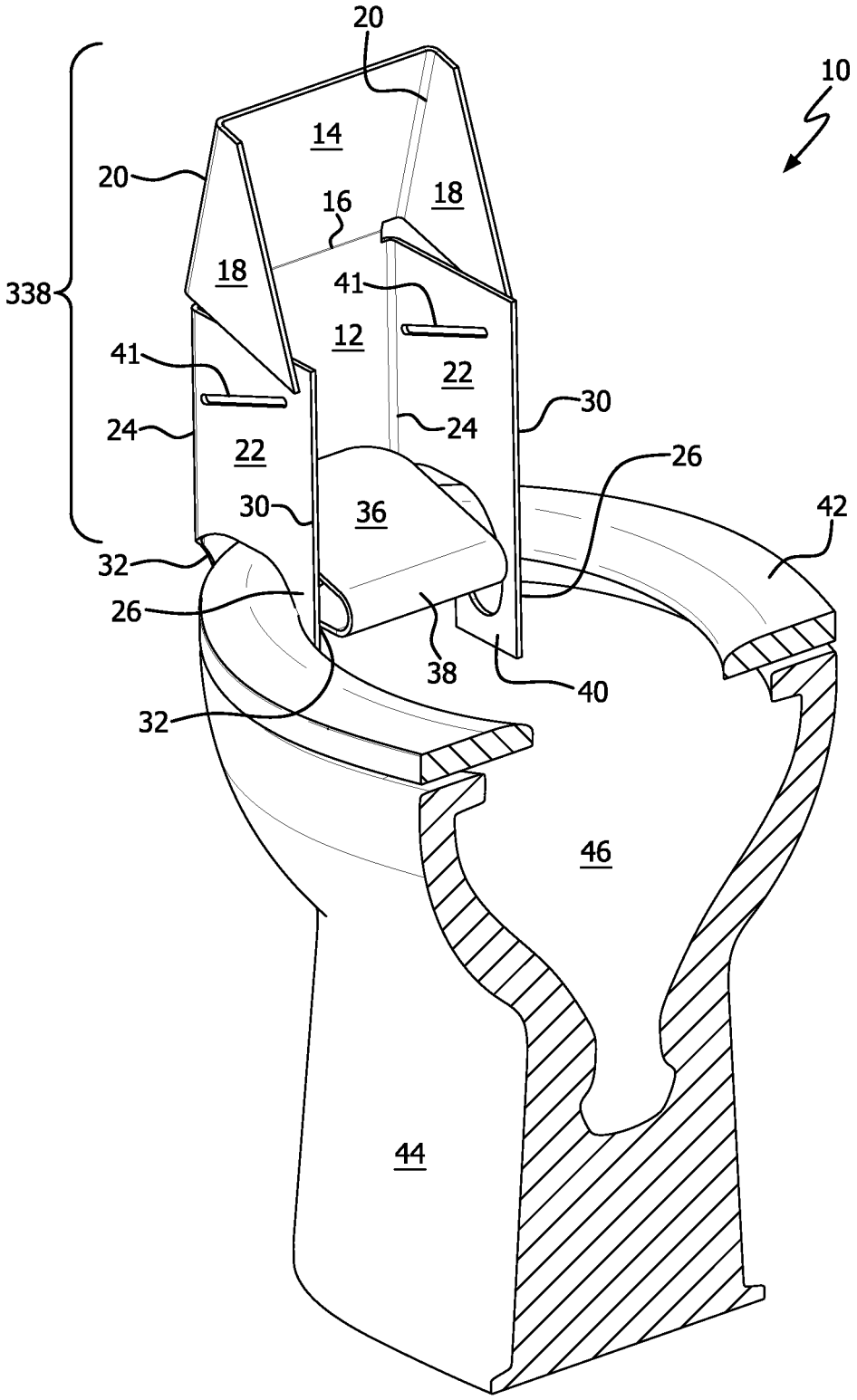
FIG. 3 is an environmental, perspective view of the splash guard of FIG. 1 being placed on a toilet.
Figure 4:
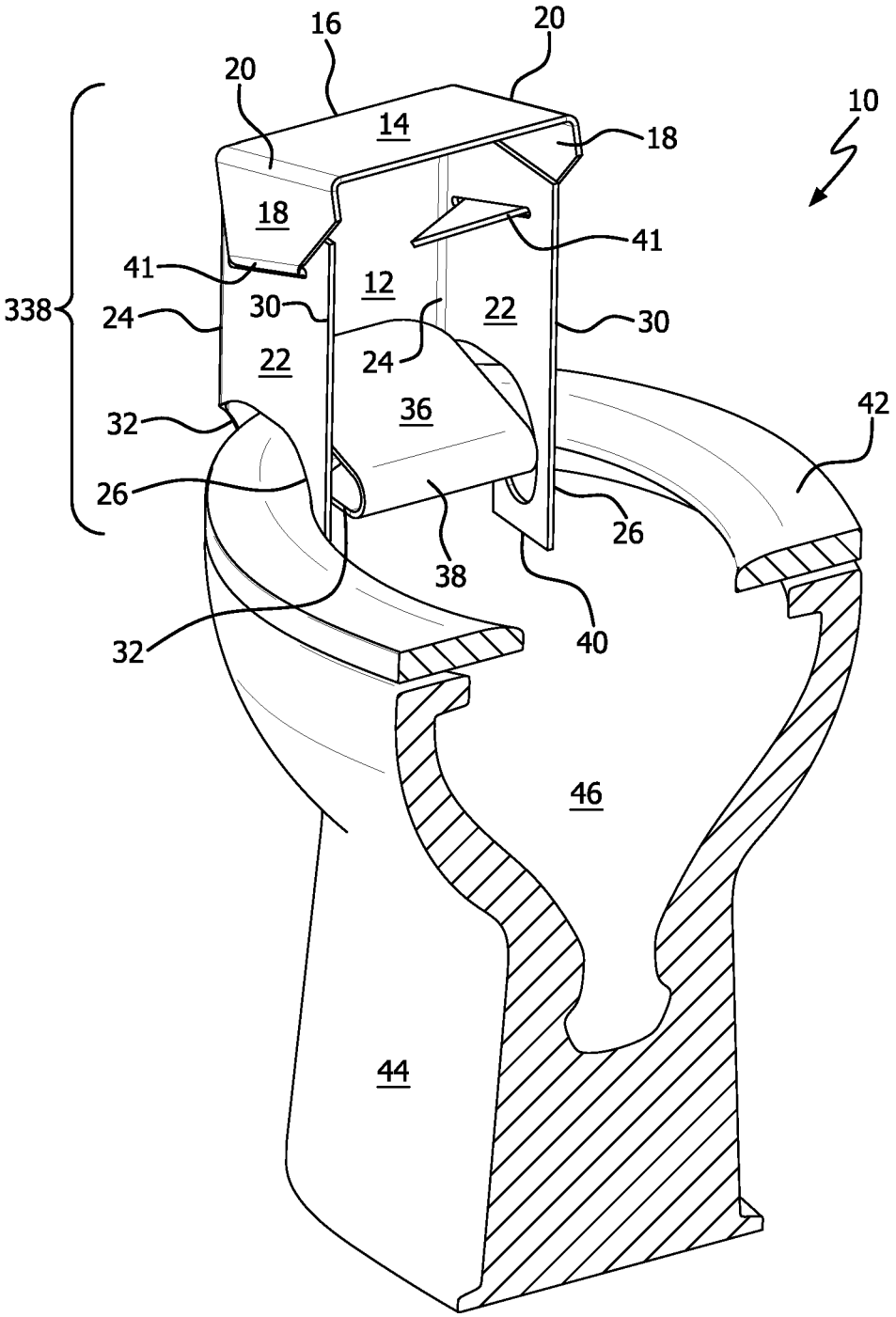
FIG. 4 is an environmental, perspective view of the splash guard of FIG. 1 after placement on a toilet.

When use of the splash guard 10 is needed, the splash book guard 10 can be secured above the seat 42 of a toilet 44 as illustrated in FIGS. 3 and 4. The splash guard 10 will typically be secured to the front of the toilet seat 42. The flap 32 will be extended between the toilet seat 42 and bowl 46. The flap 36 can then be folded back towards the back panel 12. The back panel 12 is positioned to extend upward from the toilet seat 42. Each of the side panels 22 is folded inward, so that the lower surface 28 extends across the toilet seat 42, and each of the arms 40 hooks around the inside edge 48 of the toilet seat 42. The top panel 14 is then folded down across the top of the space defined between the back panel 12 and side panels 22. The side flaps 18 can also be folded downward, and can be held in place by positioning the side flaps 18 inside the slots 41. With the splash guard 10 in this position, urine that may be directed above the toilet seat 42 will be intercepted by the shield portion 338 formed by the back panel 12, side panels 22, and top panel 14, where will fall downwards on top of the seat protector 36, and then back into the bowl 46 of the toilet 44. After use, the splash guard 10 may be disposed of either by depositing it into a trash receptacle, or flushing the splash guard 10 down the toilet, depending upon the material with which the splash guard 10 is made.

Figure 5:
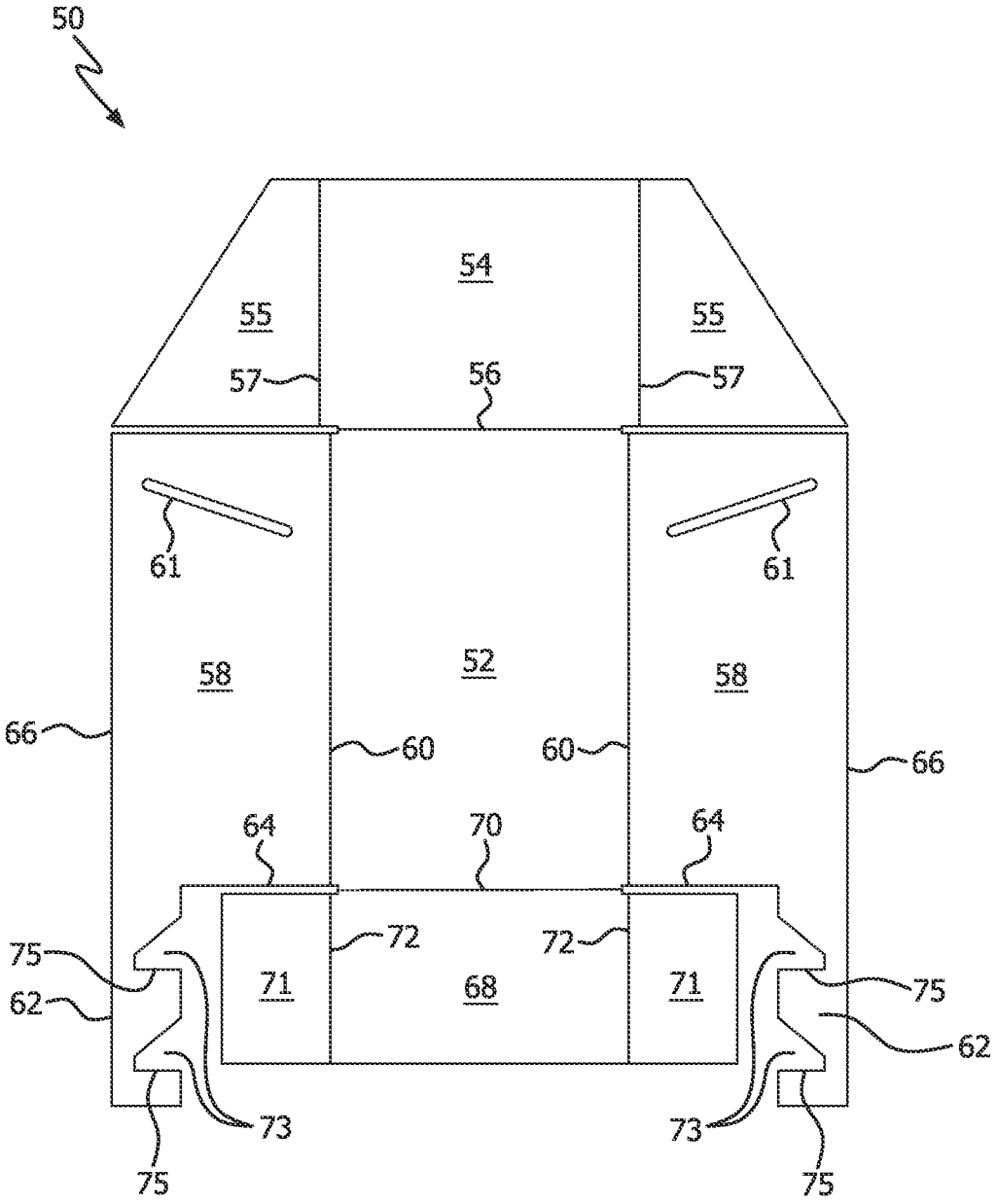
FIG. 5 is a top plan view of a second example of a disposable splash guard.
Figure 6:
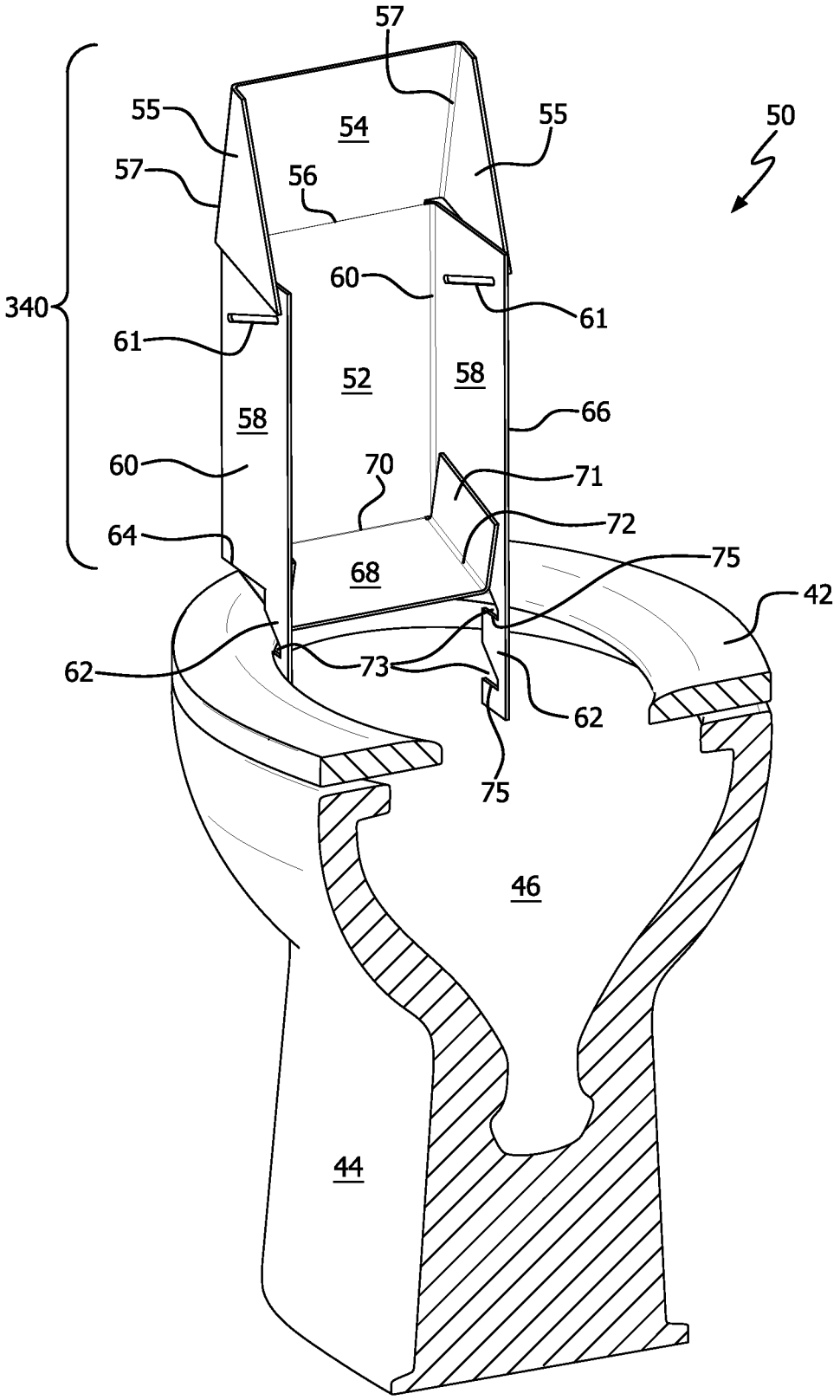
FIG. 6 is an environmental, perspective view of the splash guard of FIG. 4 being placed on a toilet.
Figure 7:
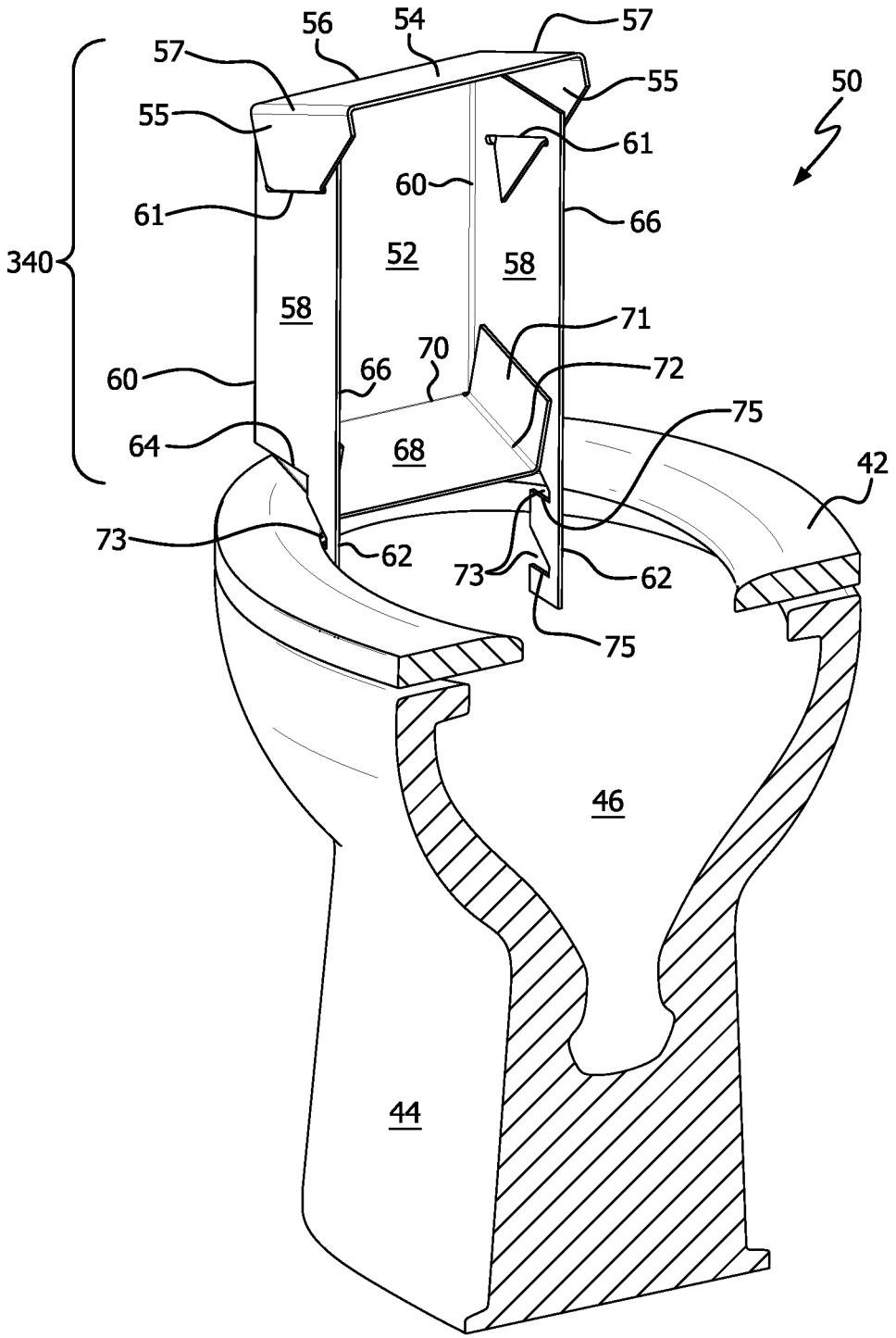
FIG. 7 is environmental, perspective view of the splash guard of FIG. 4 after placement on a toilet.

Another example of a splash guard 50 is illustrated in FIGS. 5-7. The splash guard 50 can be made from a single sheet of any suitable material as described above. Referring to FIG. 5, the splash guard 50 includes a back panel 52. A top panel 54 extends upward from the back panel 52, with a hinge 56 being defined therebetween. An upper side panel 55 extends from each side of the top panel 54, with a hinge 57 defined therebetween. A side panel 58 is located either side of the back panel 52, with a hinge 60 being defined therebetween. A slot 61 is defined within each side panel 58. An arm 62 extends downward from each bottom edge 64 of the side panels 58, proximate to the forward edge 66 of each side panel 58. A seat flap 68 extends downward from the back panel 52, with a hinge 70 defined therebetween. A lower side flap 71 extends from either side of the bottom panel 68, with a hinge 72 defined therebetween. Although not shown in the illustrated example, a seat protector similar to the seat protector 36 in FIG. 1 may optionally extend downward from the seat flap 68.

The arms 62 are designed to accommodate a variety of toilet seat configurations. Each of the arms 62 includes a plurality of slots 73, which in the illustrated example each include a substantially horizontal lower edge 75 that is structured to hook under a toilet seat 42. Having multiple slots 73 permits the splash guard 50 to accommodate multiple different toilet seats 42.

When the splash guard 50 is being transported or stored, it may be folded along the hinge or fold lines into a compact, flattened configuration in a manner that is similar to that illustrated in FIG. 2. Some examples may include an envelope, pouch, or other storage container to hold one or more splash guards 50 in this folded configuration. The splash guard 50 may thereby easily be transported by an individual with special needs, or a caregiver for such an individual.

As shown in FIGS. 6-7, when the splash guard 50 is needed, the seat flap 68 may be positioned above the toilet seat 42. The side panels 58 can be folded inward so that their bottom edges 64 are adjacent to the toilet seat 42, and so that the lower side flaps 71 are contained inside the side flaps 58 to help direct urine into the bowl 46. The arms 62 extend downward along the inner edge 48 of the toilet seat 42. The top panel 54 can then be folded downward, with the upper flaps 55 being inserted into the slots 61. The resulting shield portion 340 of the splash guard 50 is defined by the back panel 52, top panel 54, and side panels 58. Any urine passing above the seat 42 is likely to be intercepted by this shield portion 34Q and redirected back into the bowl 46. After use, the splash guard 50 is discarded.

Figure 8:
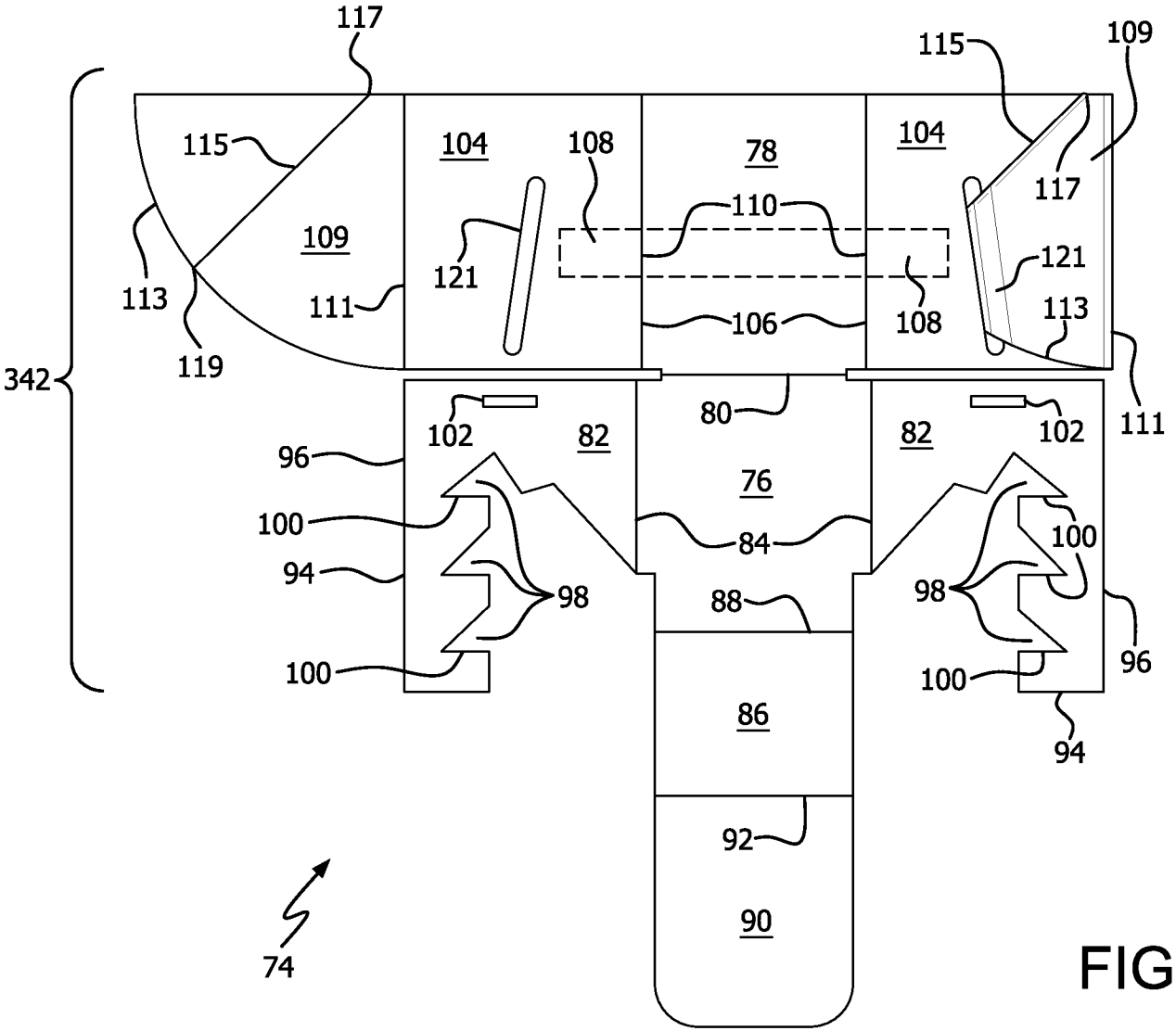
FIG. 8 is a top plan view of a third example of a disposable splash guard.

Another example of a splash guard 74 is illustrated in FIGS. 8-11. As best shown in FIG. 8, the splash guard 74 includes a back panel 76. A top panel 78 extends upward from the back panel 76, with a hinge or fold 80 defined therebetween. A pair of side panels 82 are located on either side of the back panel 76, with a hinge 84 defined between each side panel 82 and the back panel 76. A seat flap 86 is defined below the back panel 76, with a hinge 88 defined therebetween. An optional seat protector 90 is located below the seat flap 86, with a hinge 92 defined therebetween. A pair of arms 94 extend downward from the side panels 82, proximate to the forward edges 96 of the side panels 94. Each of the arms 94 defines a plurality of cutouts 98, each of which includes a lower surface 100 which in the illustrated example is substantially horizontal. Each of the arms 94 also defines a slot 102. The illustrated example of the top panel 78 includes a pair of upper side flaps 104 extending outward from either side, with a hinge or fold 106 defined between each flap 104 and the top panel 76. A tab 108 also extends outward from each side of the top panel 78. In the illustrated example, each tab 108 is separate from each flap 104, and is attached to the top panel 78, with a hinge or fold 110 defined therebetween. Thus, in the illustrated example, at least the top panel 78 will include at least two layers of material. In other examples, the tabs 108 may be formed as a part of the flaps 104. The tabs 108 are structured to fit within the slots 102, securing the splash guard 74 in the appropriate configuration for use.

When the splash guard 74 is being transported or stored, it may be folded along the fold lines into a compact, flattened configuration in a manner that is similar to that illustrated in FIG. 2. Some examples may include an envelope, pouch, or other storage container to hold one or more splash guards 74 in this folded configuration. The splash guard 74 may thereby easily be transported by an individual with special needs, or a caregiver for such an individual.

A pair of upper end flaps 109 extend from each of the upper side flaps 104, with a hinge 111 defined therebetween. Each of the upper end flaps 109 defines a curved lower edge 113, and a diagonal hinge 115 extending from a position adjacent to the corner 117 to a middle portion 119 of the curved lower edge 113. A slot 121 is defined within each upper side panel 104. The size of the splash guard 74 may thereby by adjusted by folding either one or both of the folds 111, 115, and possibly by inserting the upper end panel 109 into the slot 121.

Figure 9:
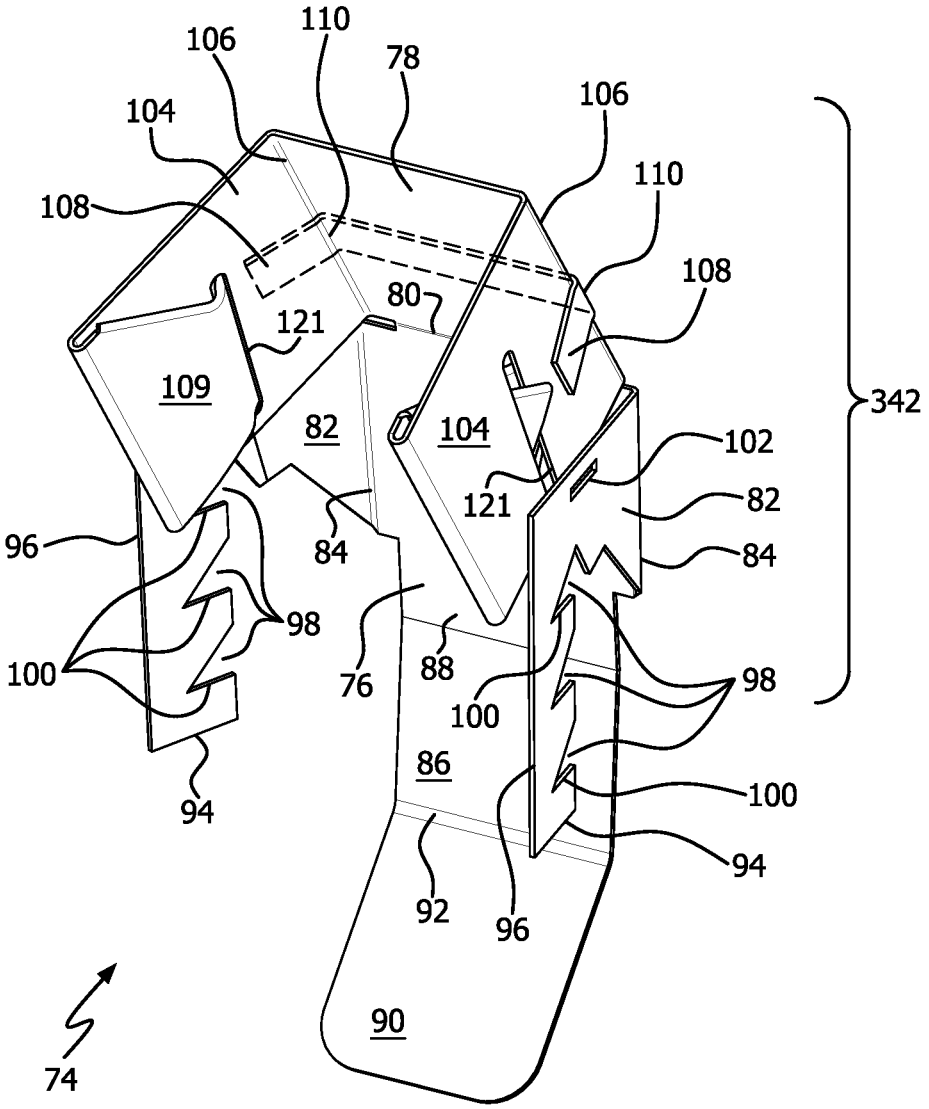
FIG. 9 is a perspective view of the splash guard of FIG. 7, showing the splash guard configured for installation on a toilet.
Figure 10:
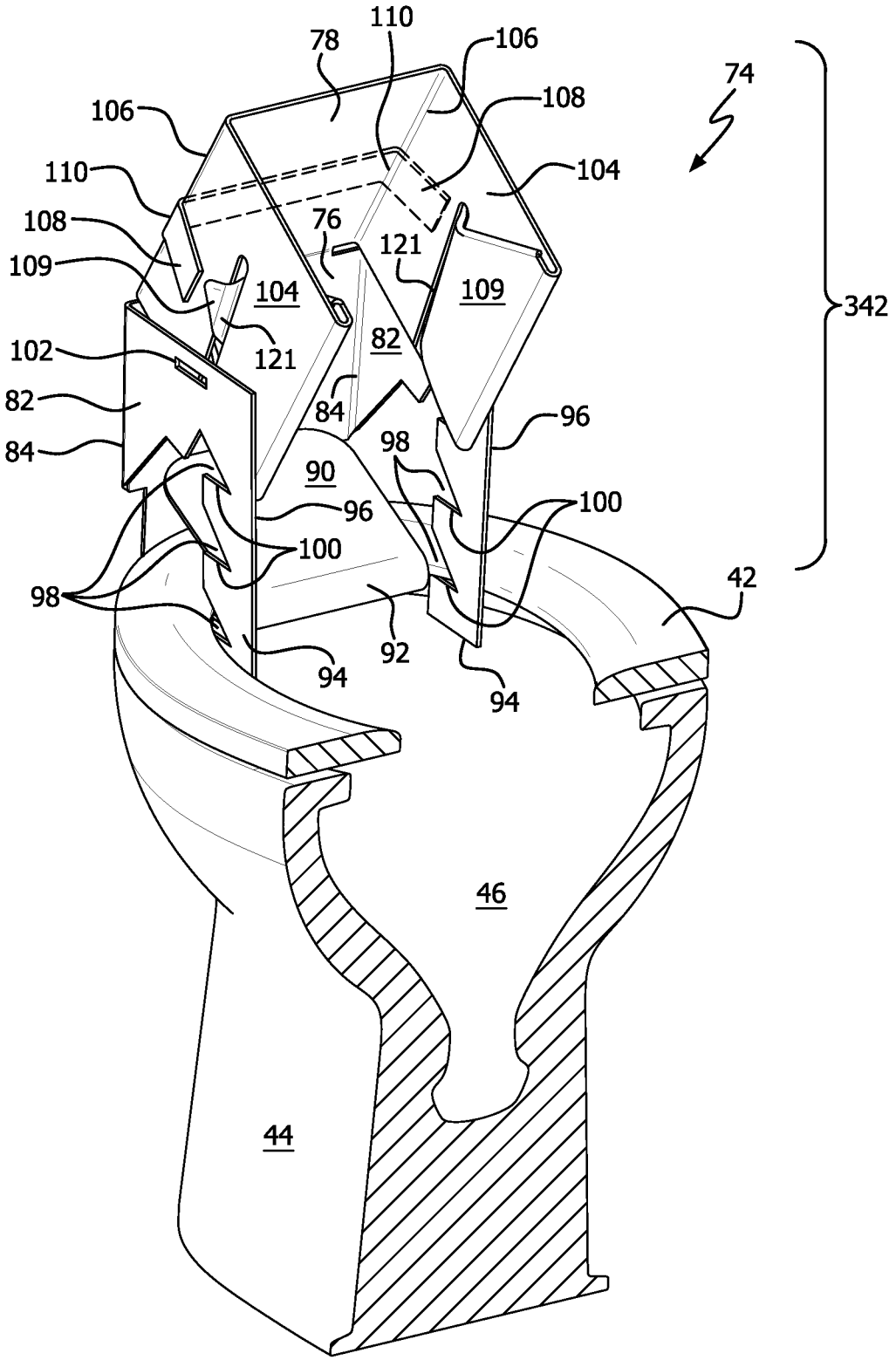
FIG. 10 is an environmental, perspective view of the splash guard of FIG. 7, showing the splash guard being installed on a toilet.
Figure 11:
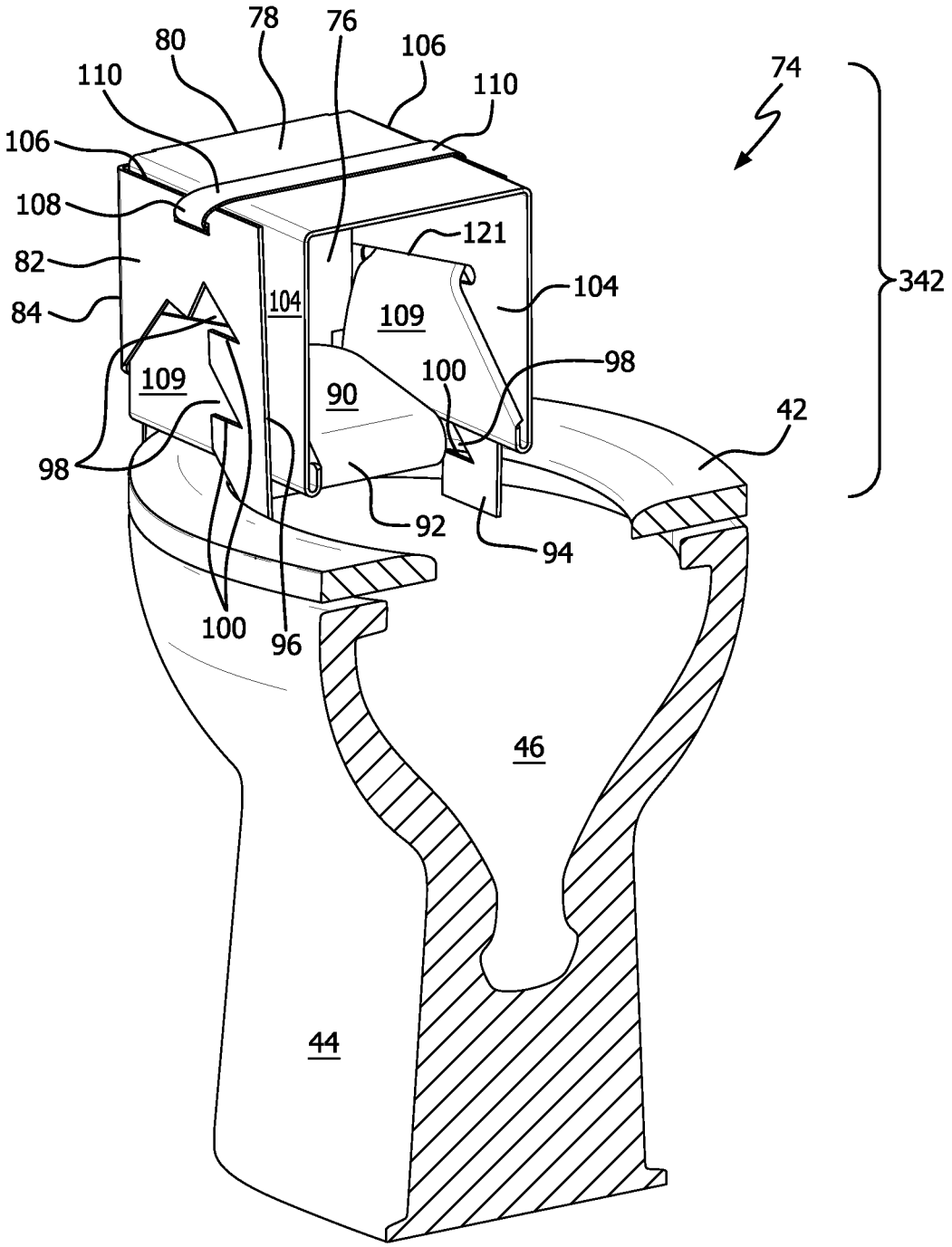
FIG. 11 is an environmental, perspective view of the splash guard of FIG. 7, showing the splash guard installed on a toilet.
Figure 12:
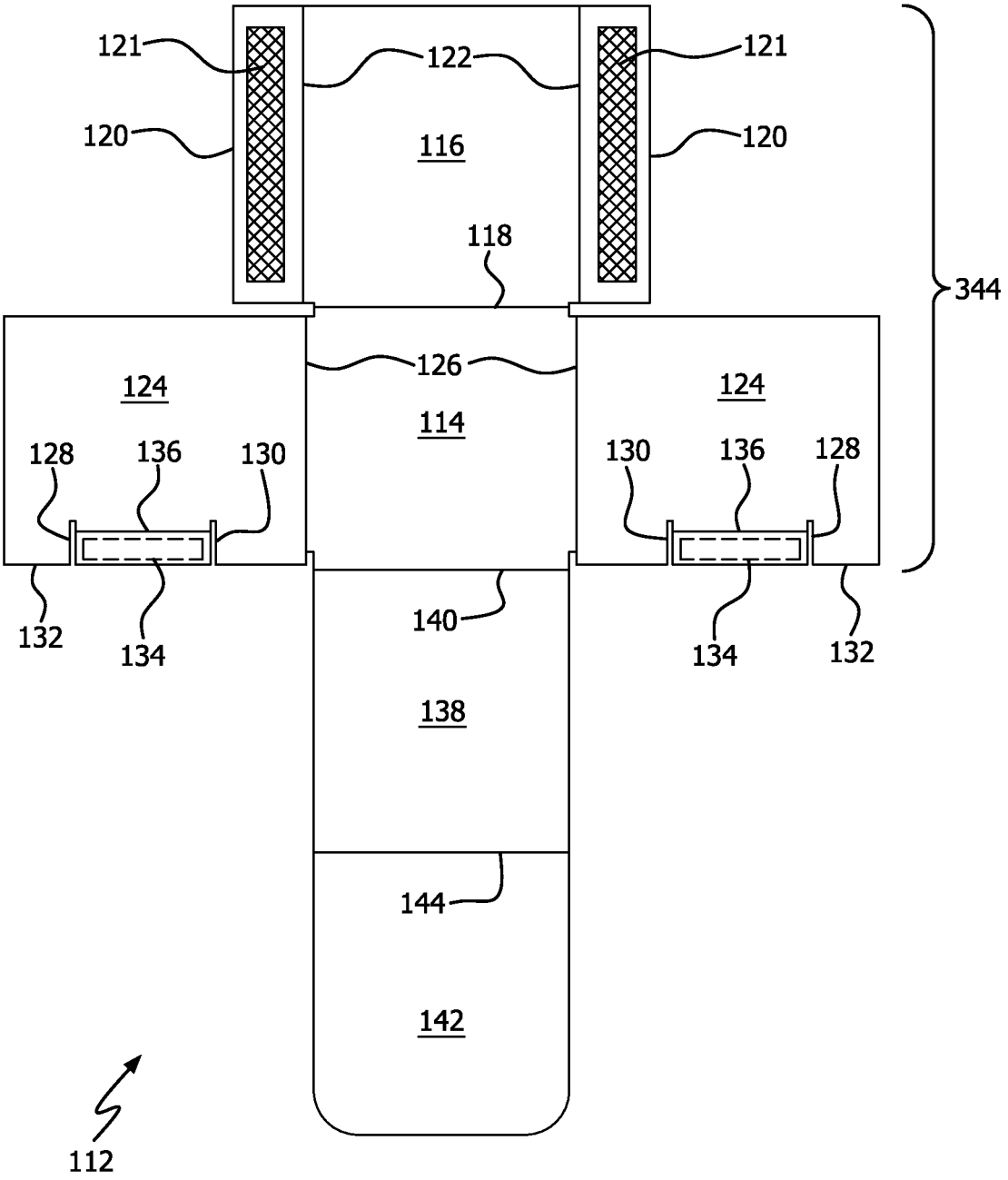
FIG. 12 is a top plan view of a fourth example of a disposable splash guard.
Figure 13:
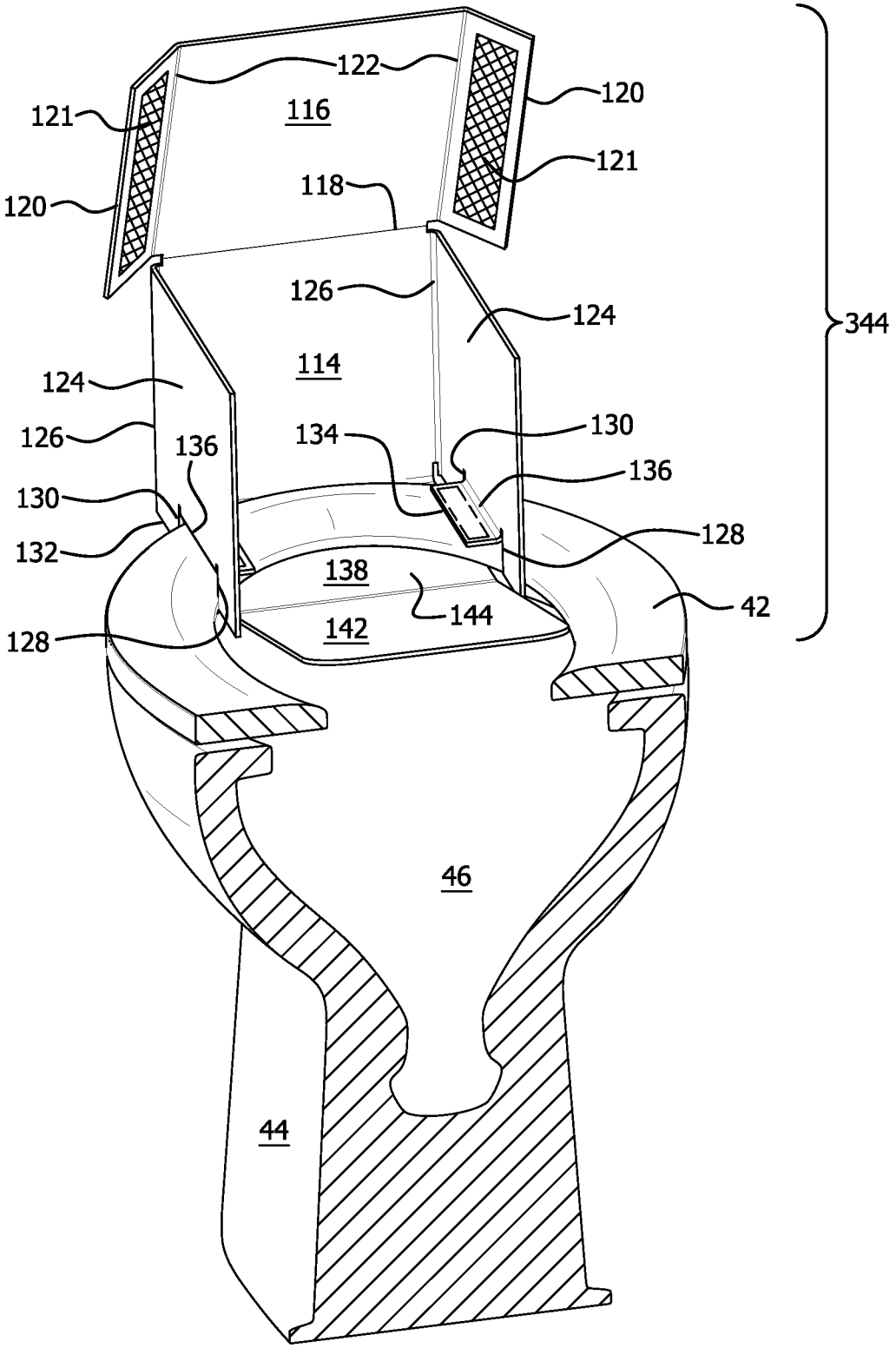
FIG. 13 is an environmental, perspective view of the splash guard of FIG. 11, showing the splash guard being installed on a toilet.
Figure 14:
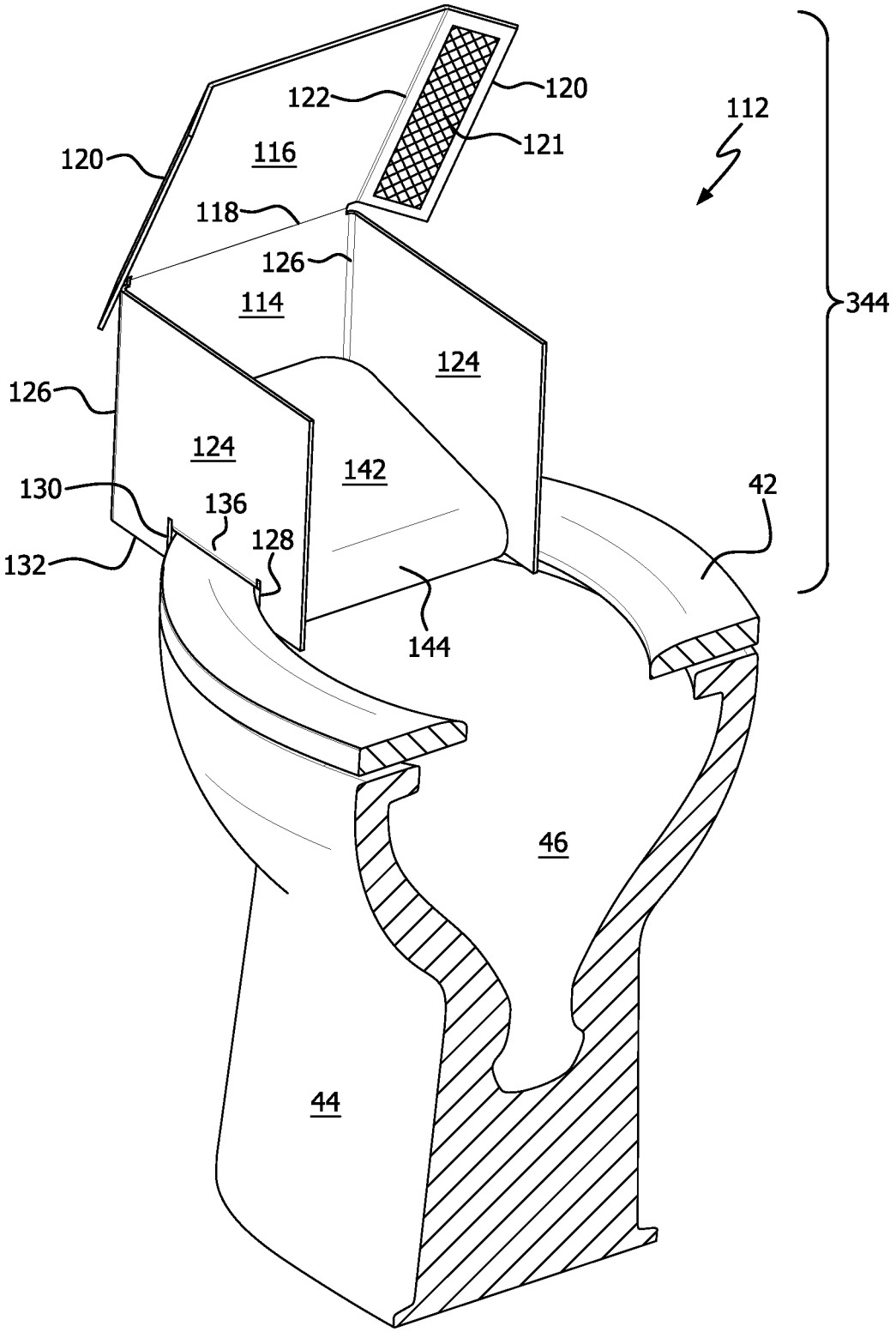
FIG. 14 is an environmental, perspective view of the splash guard of FIG. 11, showing the splash guard installed on a toilet.
Figure 15:
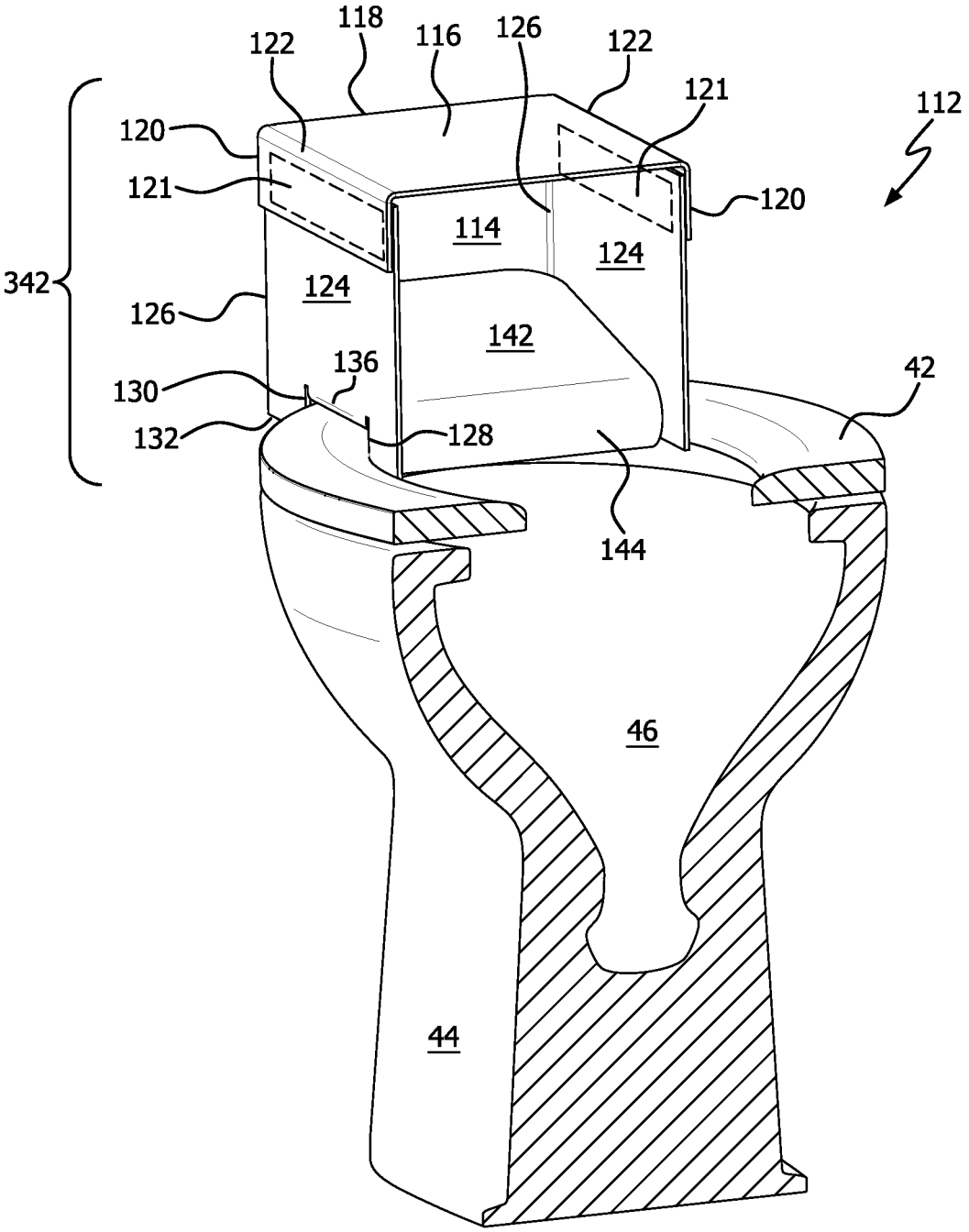
FIG. 15 is another environmental, perspective view of the splash guard of FIG. 11, showing the splash guard installed on a toilet.
Figure 16:
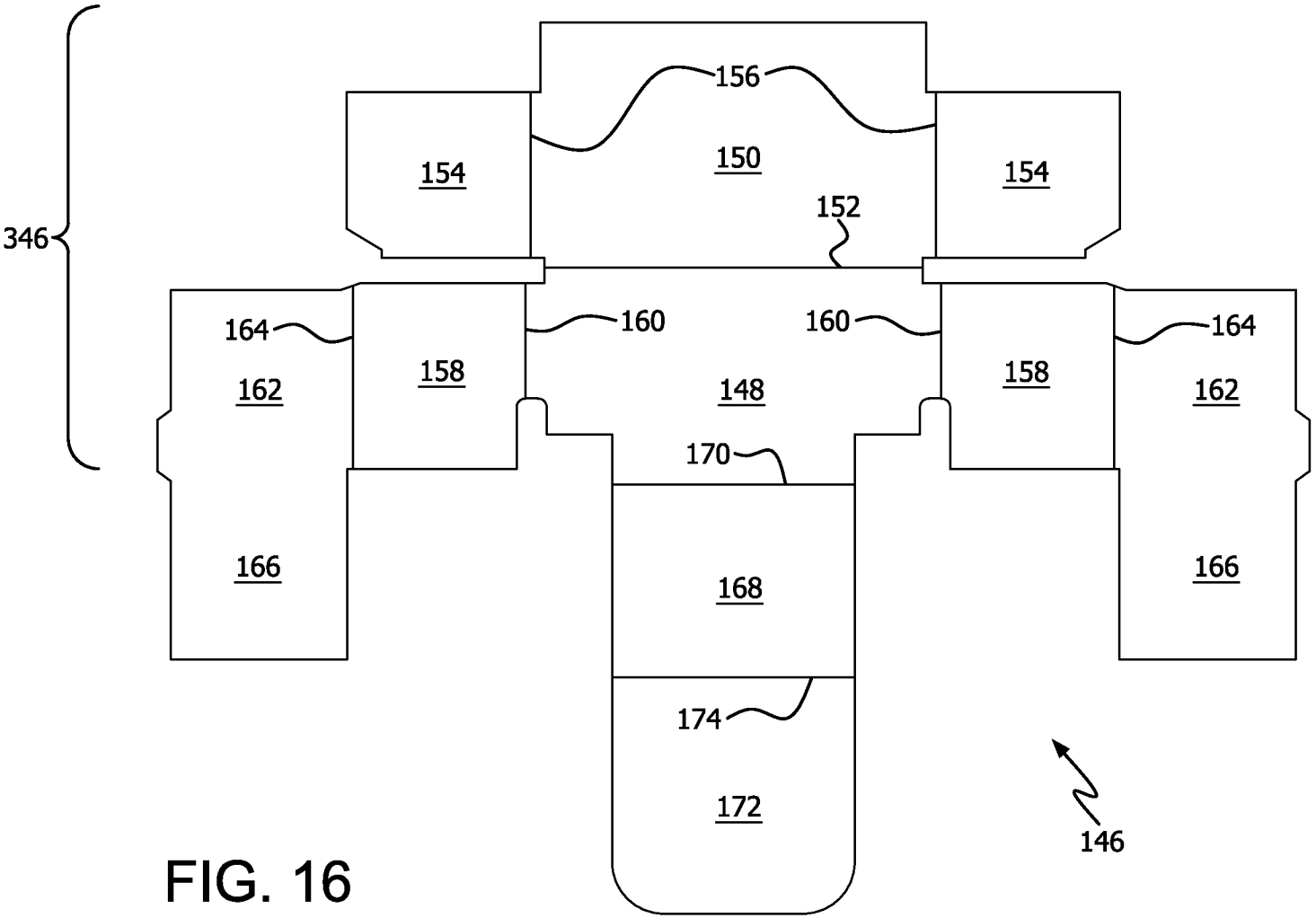
FIG. 16 is a top plan view of a fifth example of a disposable splash guard.

Referring to FIGS. 9-11, the arms 82 can each be folded inward along the hinges 84, and the top flap 78 can be folded downward along the hinge 80 so that they are inside the arms 82. The tabs 108 are inserted into the slots 102 to hold the splash guard 74 in this configuration, thus forming the shield portion 342. The seat flap 86 can then be slid beneath the toilet seat 42. One of the surfaces 100 engages with the bottom of the inner edge 48 of the toilet seat 42. The seat protector 90, if present, can then be folded upward to guard the toilet seat 42. With the splash guard 74 so positioned, urine the passes above the toilet seat 42 will be intercepted by the splash guard 74 and redirected back into the bowl 46.

FIGS. 12-15 illustrate yet another example of a splash guard 112. The splash guard 112 includes a back panel 114 having a top panel 116 extending upwards therefrom, with a hinge or fold 118 defined therebetween. The illustrated example of the top panel includes a pair of upper side flaps 120 on either side, with each side panel 120 being separated from the top panel 116 by a hinge 122. The illustrated example includes pressure-sensitive adhesive on one side of each upper side flap 120. The splash guard 112 also includes a pair of side panels 124 extending from either side of the back panel 114, and separated from the back panel 114 by a fold or hinge 126. Each side panel 124 includes a pair of slots 128, 130 extending upward from the bottom surface 132. A flap 134 is defined between each pair of slots 128, 130. A fold or hinge 136 is disposed across the top of each flap 134. A seat panel 138 extends below the back panel 114, being separated from the back panel 114 by a hinge or fold 140. A seat protector 142 extends downward from the seat flap 138, with a fold or hinge 144 therebetween.

When the splash guard 112 is being transported or stored, it may be folded along the fold lines into a compact, flattened configuration in a manner that is similar to that illustrated in FIG. 2. Some examples may include an envelope, pouch, or other storage container to hold one or more splash guards 112 in this folded configuration. The splash guard 112 may thereby easily be transported by an individual with special needs, or a caregiver for such an individual.

To use the splash guard 112, the seat flap 138 is positioned below the toilet seat 42. Each of the side panels 124 is folded inwards that it is positioned above the toilet seat 42. The top panel 116 is folded downward, and the upper side flaps 120 are folded downward so that the pressure sensitive adhesive 121 can be secured to the side flaps 124. The flaps 134 our folded upward, so that the toilet seat 42 is located in the region between the slots 128, 130. The top panel 116 is folded downward, and each of the side flaps 120 is folded inward, forming the shield portion 344. The seat protector 142 can be folded upward and over the top of the toilet seat 42.

FIGS. 16-19 illustrate another example of a splash guard 146. The splash guard 146 includes a back panel 148 with a top panel 150 extending upward from the back panel 148. A fold or hinge 152 separates the back panel 148 and top panel 150. A pair of top flaps 154 extend outward from either side of the top panel 150. A fold or hinge 156 separates each top flap from the top panel 150. A pair of first side panels 158 extend outward from the back panel 148, being separated from the back panel 148 by hinges 160. Second side panels 162 extend outward from each of the first side panels 158, with hinges 164 separating the first side panels 158 and second side panels 162. The second side panels 162 each include a downwardly extending portion 166. A seat flap 168 extends downward from the back panel 148, and is separated from the back panel 148 by a fold or hinge 170. A seat protector 172 extends downward from the seat flap 168, with a fold or hinge 174 therebetween.

When the splash guard 146 is being transported or stored, it may be folded along the fold lines into a compact, flattened configuration in a manner that is similar to that illustrated in FIG. 2. Some examples may include an envelope, pouch, or other storage container to hold one or more splash guards 146 in this folded configuration. The splash guard 146 may thereby easily be transported by an individual with special needs, or a caregiver for such an individual.

Figure 17:
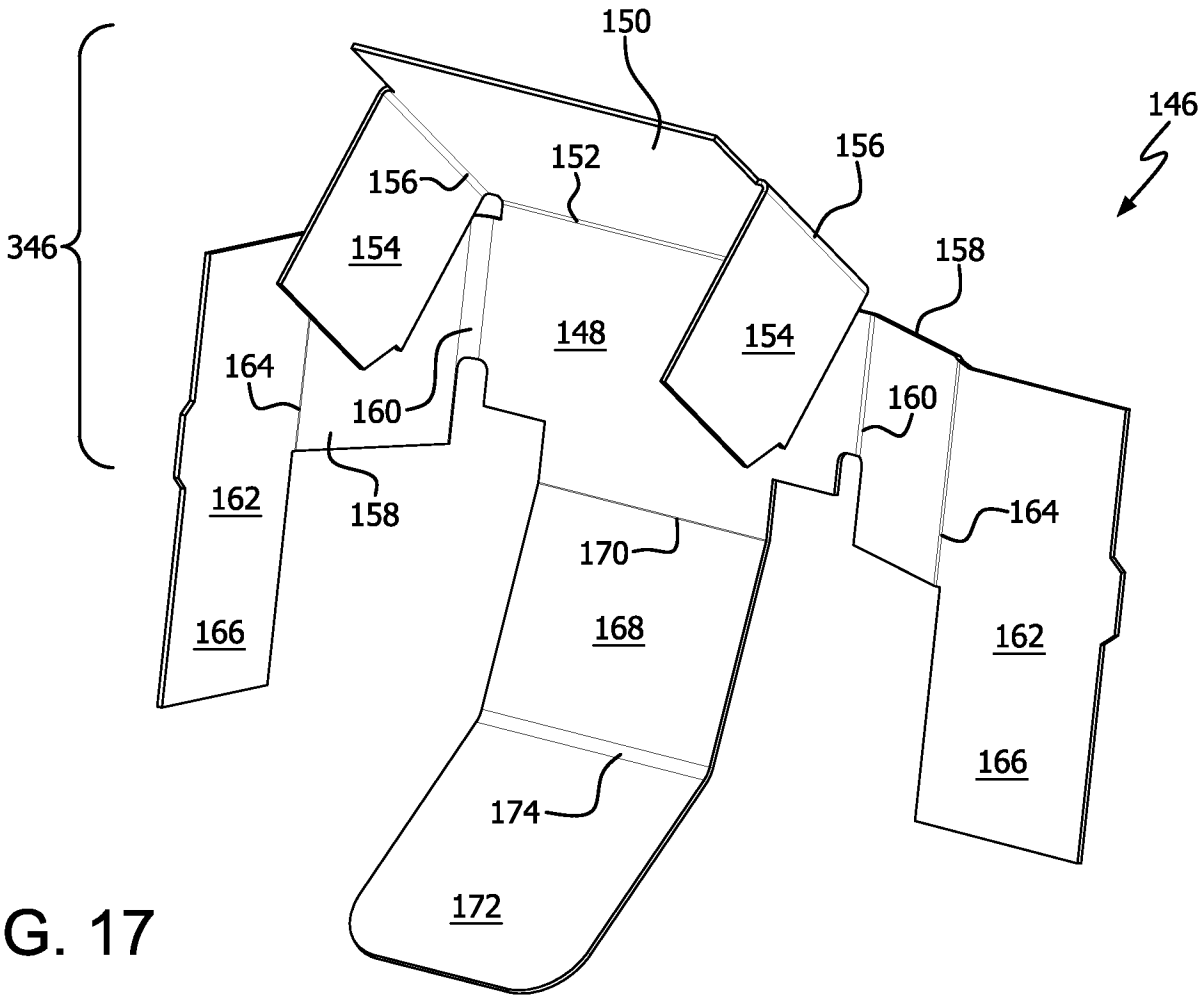
FIG. 17 is a perspective view of the splash guard of FIG. 15, showing the splash guard being configured for installation on a toilet.
Figure 18:
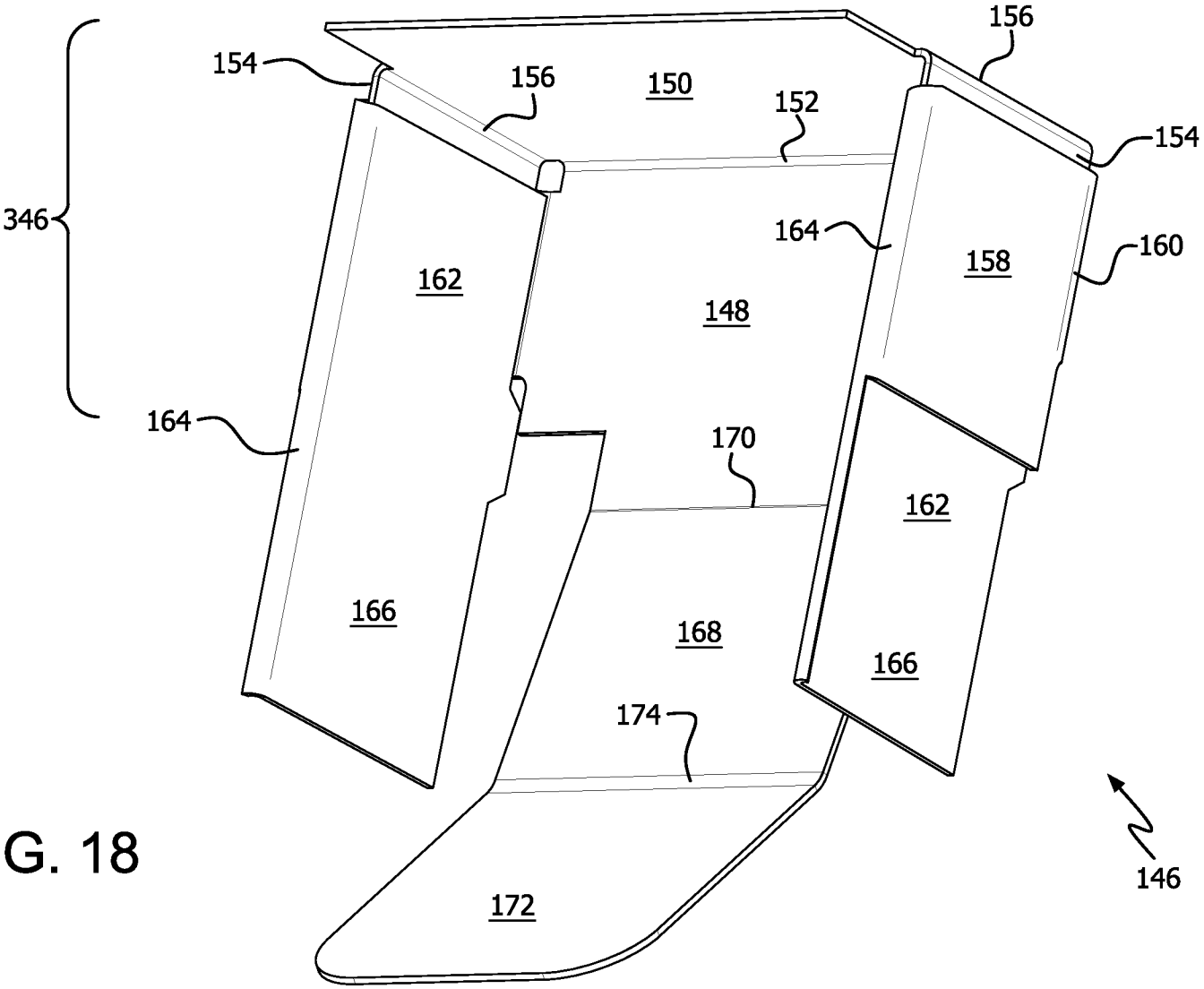
FIG. 18 is a perspective view of the splash guard of FIG. 15, showing the splash guard configured for installation on a toilet.
Figure 19:
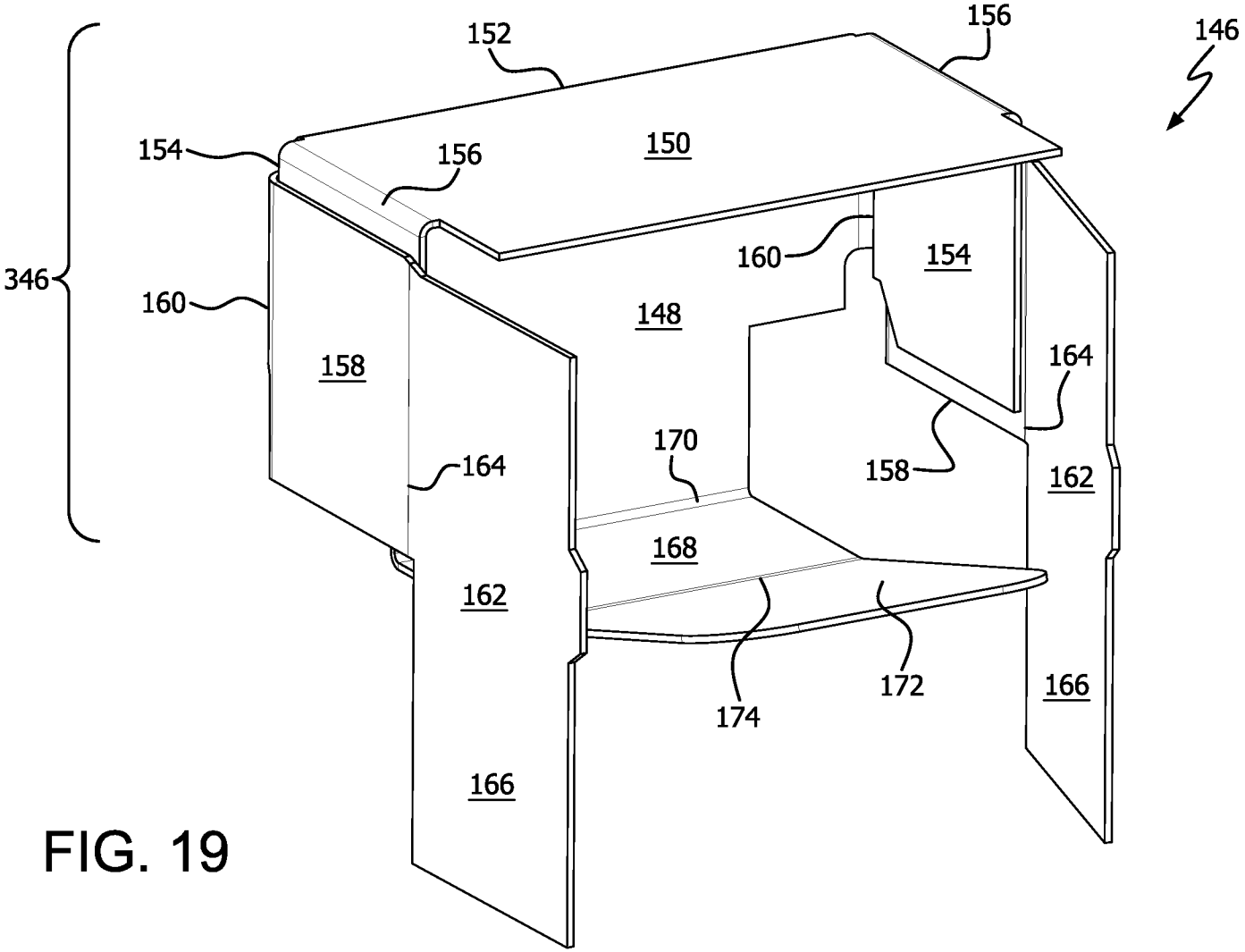
FIG. 19 is a perspective view of the splash guard of FIG. 15, showing the splash guard ready to be installed on a toilet.

As shown in FIGS. 17-19, the use of the first side panel 158 hingedly attached to a second side panel 162 provides for some adjustability in the length of the overall side panels formed by these two panels. FIG. 17 shows the splash guard 146 partially folded for use. FIG. 19 shows the hinge 164 left relatively straight, leaving a large distance between the downwardly extending portion 166 and the seat flap 168, allowing for a relatively large amount of space to receive the toilet seat 42. FIG. 18 shows the hinge 164 bent 180°, placing the second side panel 162 in a position wherein it overlaps the first side panel 158. This position will accommodate a smaller toilet seat 42. As shown in FIG. 19, the seat flap 168 may be placed underneath the toilet seat 42. The downwardly extending portions 166 are placed against the edge of the toilet seat 42. The flaps 154 are placed inside the first side panels 158 as the top panel 150 is lowered into position, forming the shield portion 346. The seat protector 172 is folded over the top of the toilet seat 42.

Figure 20:
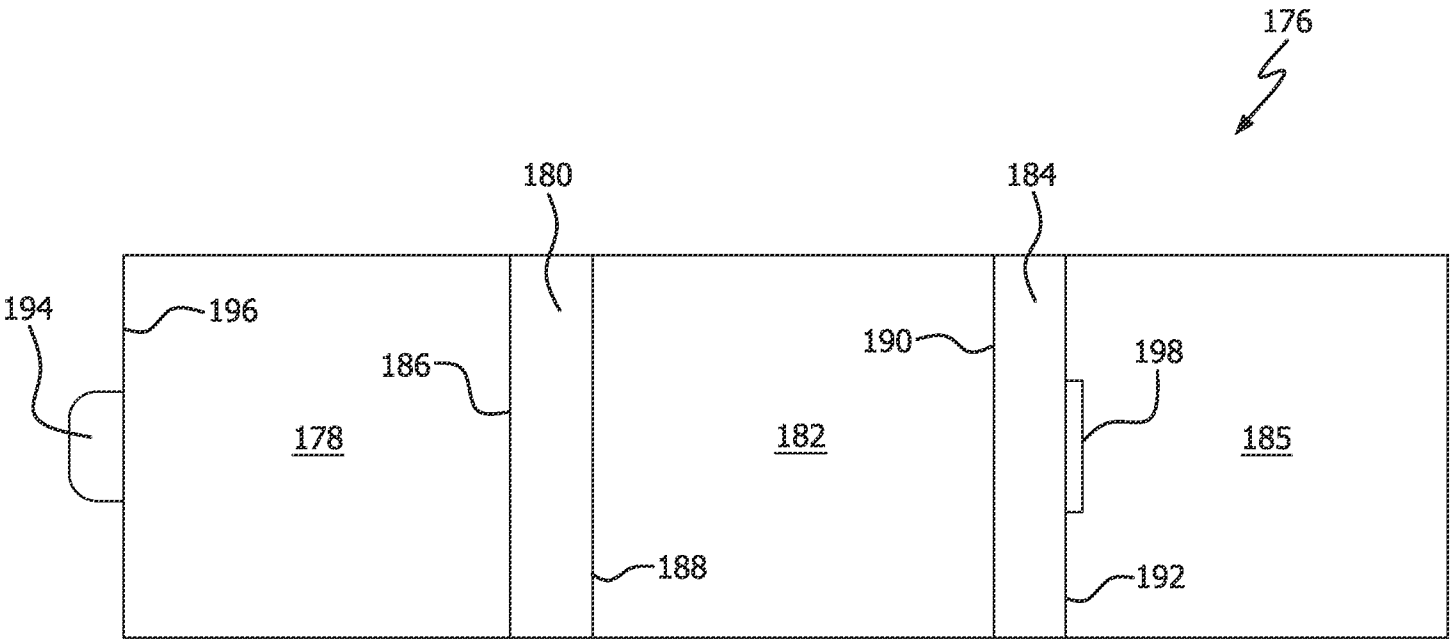
FIG. 20 is a top plan view of an envelope for use in storing and transporting a foldable splash guard, showing the envelope unfolded.
Figure 21:
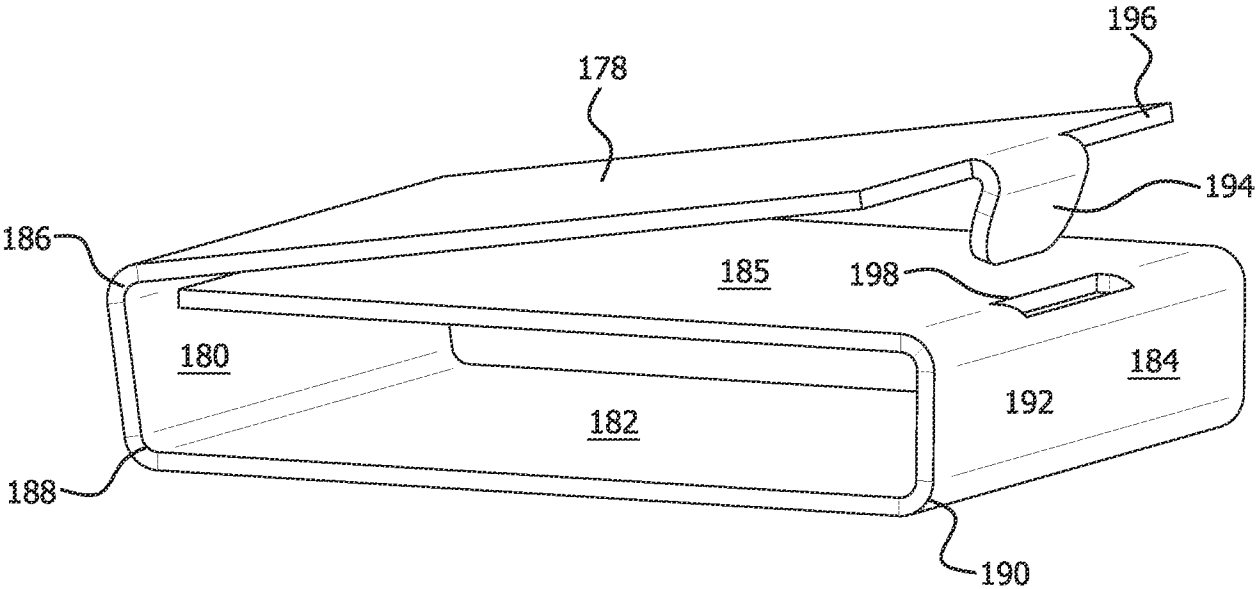
FIG. 21 is a perspective view of an envelope for use in storing and transporting a foldable splash guard, showing the envelope being folded to secure one or more splash guards.
Figure 22:
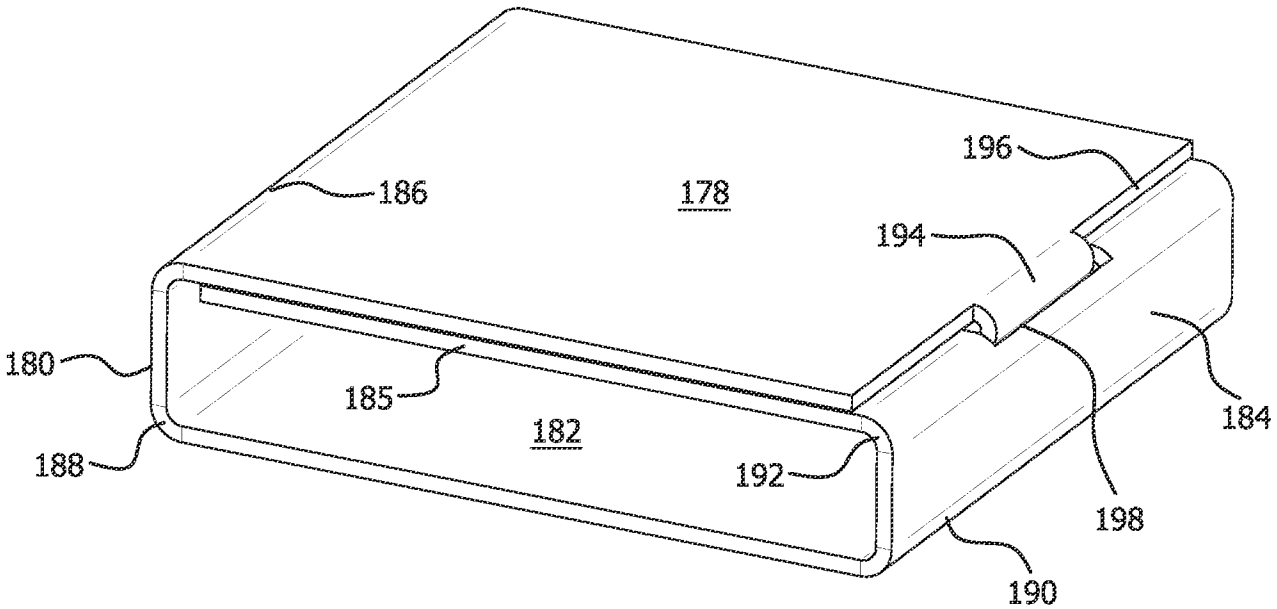
FIG. 22 is a perspective view of an envelope for use in storing and transporting a foldable splash guard, showing the envelope folded to secure one or more splash guards.

Referring to FIGS. 20-22, one or more splash guards may be conveniently carried in an envelope. The illustrated example of an envelope 176 includes a front panel 178, first side panel 180, back panel 182, second side panel 184, and inside panel 185, separated by folds or hinges 186,188,190, 192, respectively. A tab 194 protrudes from the free end 196 of the front panel 178, fitting into a slot 198 defined adjacent to the hinge 192 to close the envelope 176 around one or more folded splash guard(s).

Figure 23:
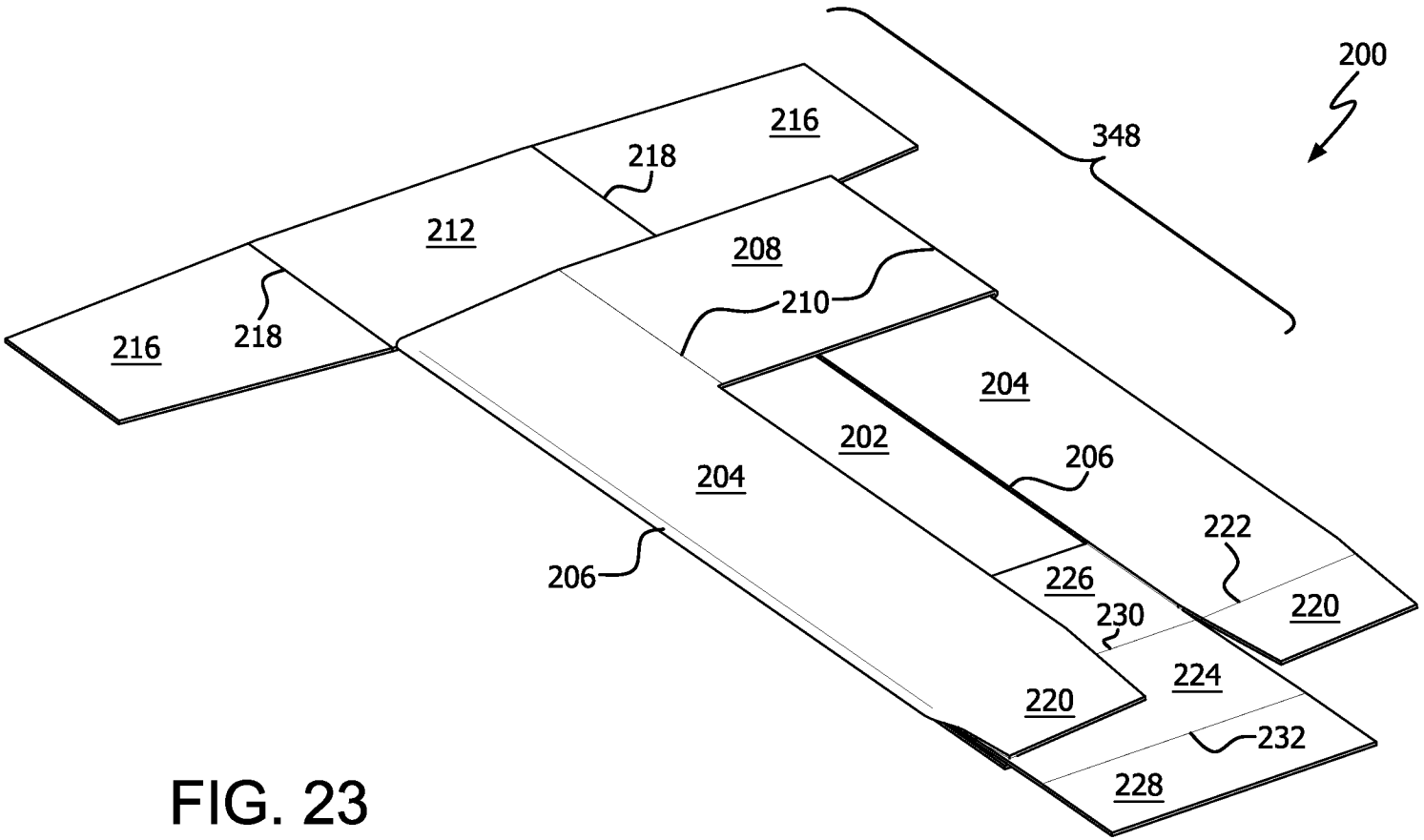
FIG. 23 is a perspective view of another example of a splash guard, showing the splash guard in a flattened configuration.
Figure 24:
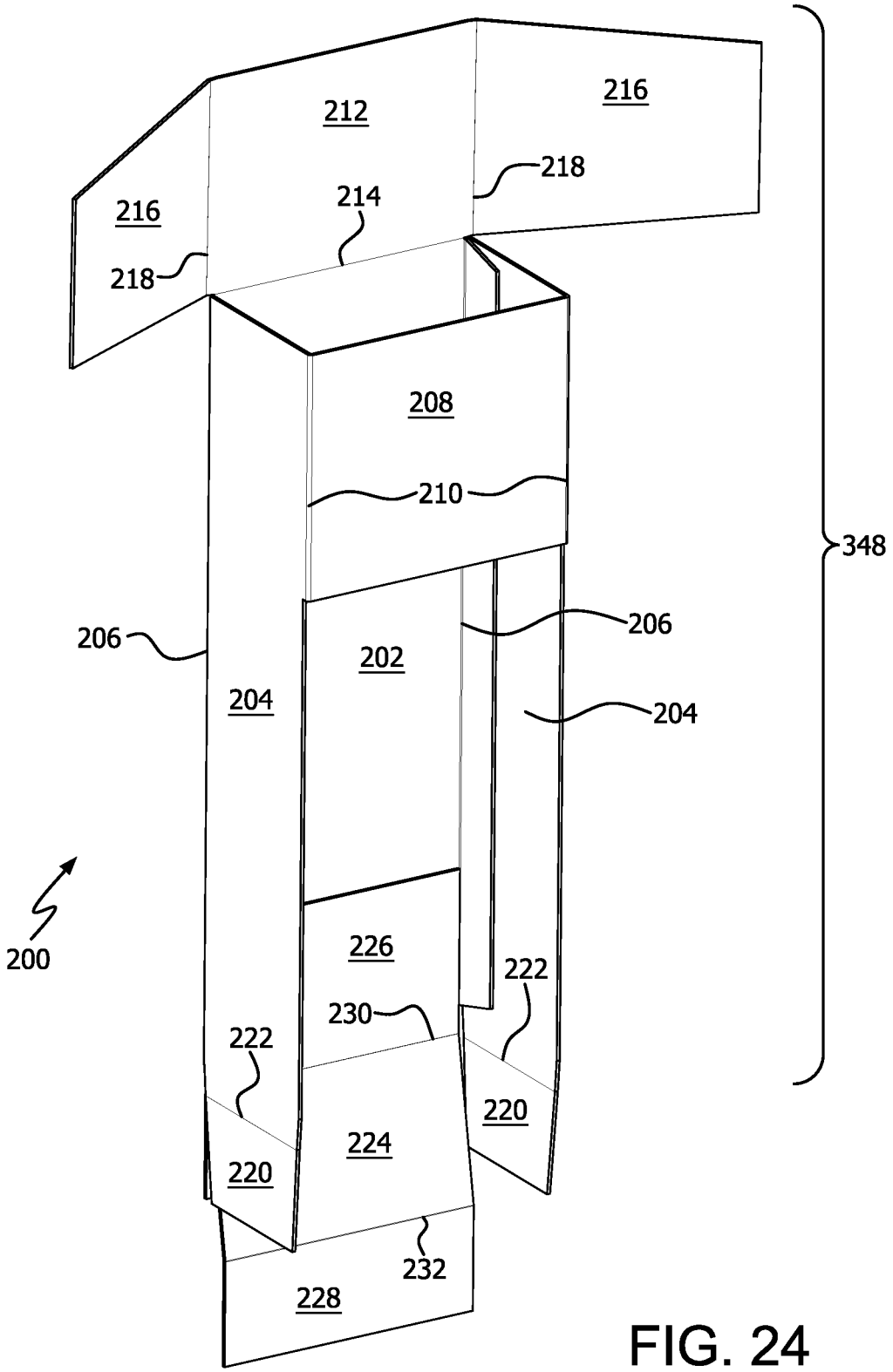
FIG. 24 is a perspective view of the splash guard of FIG. 23, showing the splash guard being prepared for use.
Figure 25:
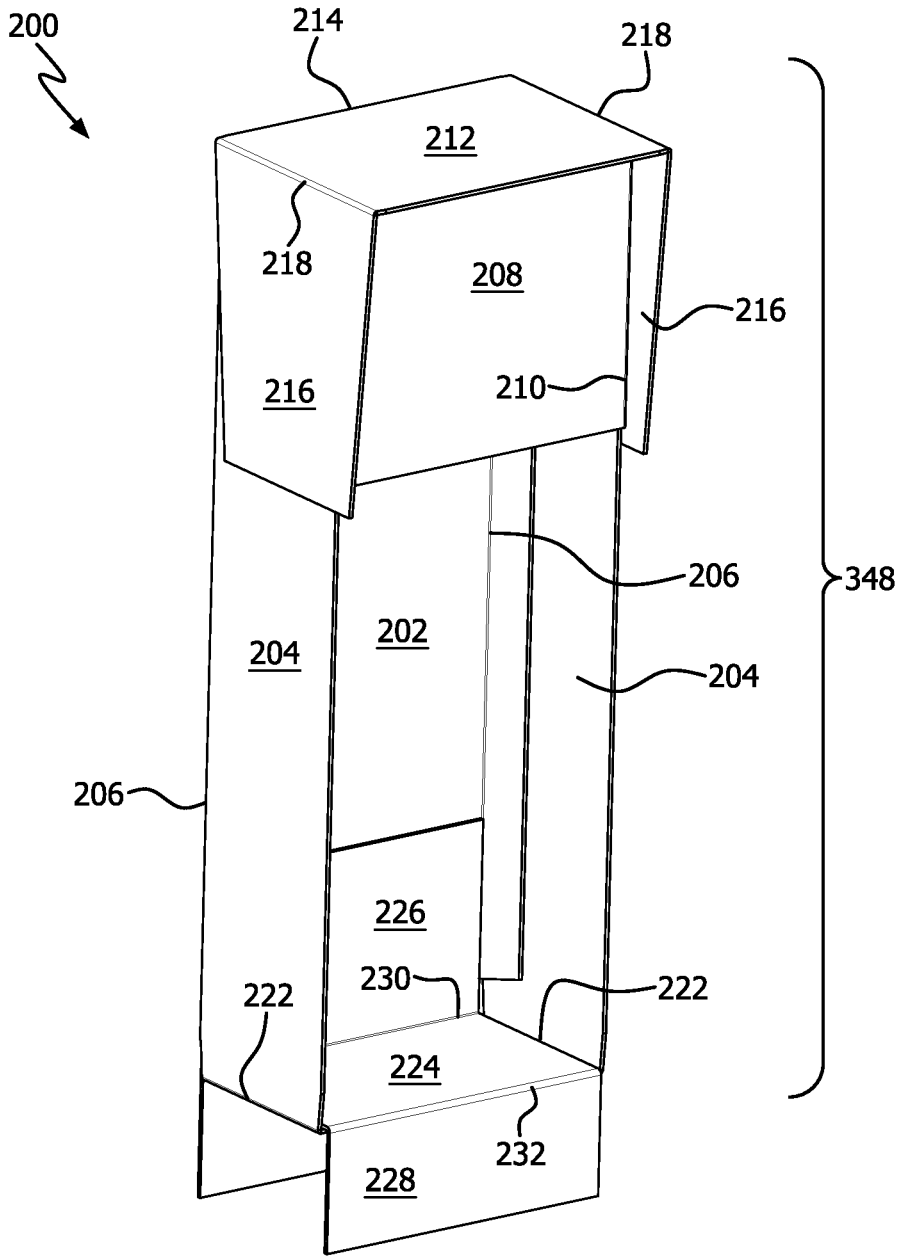
FIG. 25 is a perspective view of the splash guard of FIG. 23, showing the splash guard ready for use.

Referring to FIGS. 23-25, another example of a splash guard 200 is illustrated. The splash guard 200 includes a back panel 202, a pair of side panels 204, each of which is joined to the back panel by a hinge 206, and a front panel 208 joined to the side panels by hinges 210. A top panel 212 is joined to the back panel 202 by a hinge 214. Upper side panels 216 extend outward from the top panel 212, and are connected thereto by hinges 218. A pair of lower side flaps 220 extend downward from the sides 204, with hinges 222 defined therebetween. A bottom portion includes a bottom panel 224, an attachment panel 226 secured to the back panel 202, and then inside seat flap 228. A hinge 230 is defined between the bottom panel 224 and attachment panel 226. Similarly, a hinge 232 is defined between the bottle panel 224 and the inside seat panel 228. The back panel 202 extends downward to approximately equal the downward extension of the panel 228, so that a toilet seat 42 can fit between the panels 228, 202.

When the splash guard 200 is being stored or transported, it can be flattened as illustrated in FIG. 23 for convenient transportation. To use the splash guard 200, it is simply folded outward as shown in FIG. 24. The top panel 212 is folded downward, and the upper side panels 216 are also folded downward against the sides 204, where they can be retained in some examples by a pressure sensitive adhesive. The bottom panel 224 is folded upwards so that it is substantially horizontal, and the inside seat panel 228 is folded downward. The lower side flaps our folded upward underneath the bottom panel 224, and in some examples may be held in this position by a pressure sensitive adhesive. The splash guard 200 can then be held on a toilet seat between the user's legs, with the panel 224 resting on the seat 42, and the seat 42 passing between the panels 228, 202.

Figure 26:
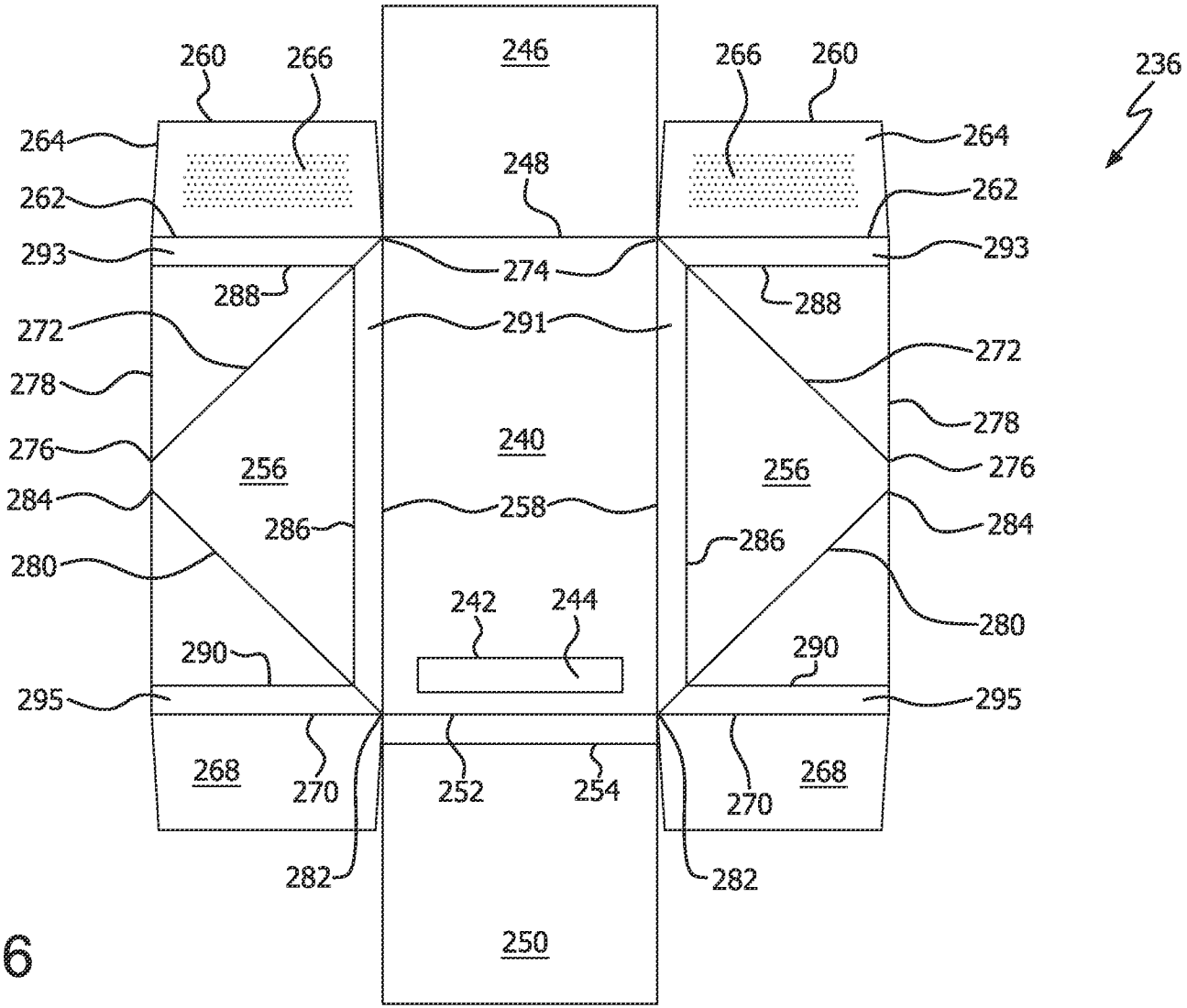
FIG. 26 is a back elevational view of a main body of yet another example of a splash guard, showing the main body flattened, and prior to attachment of the base.
Figure 28:
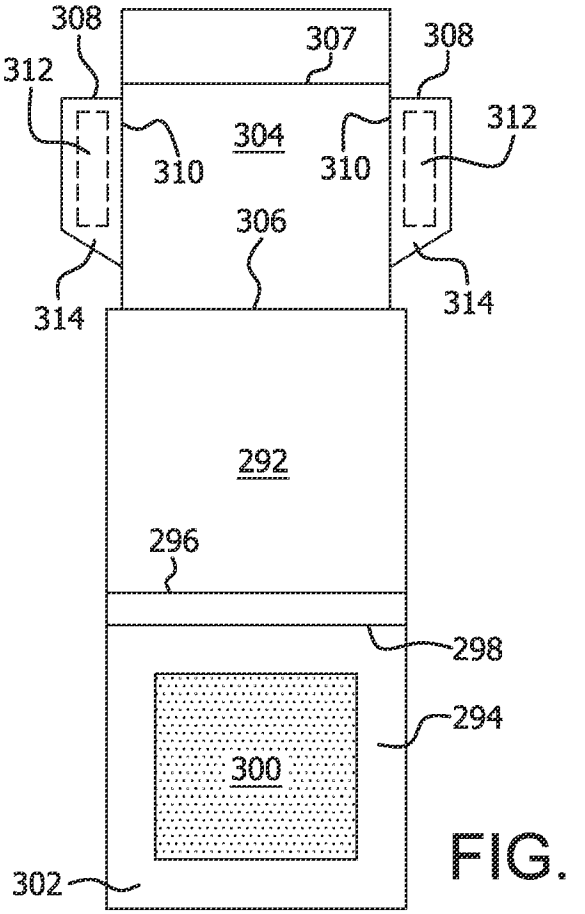
FIG. 28 is a front elevational view of a base for use in connection with the main body of FIGS. 26-27, showing the base flattened.
Figure 27:
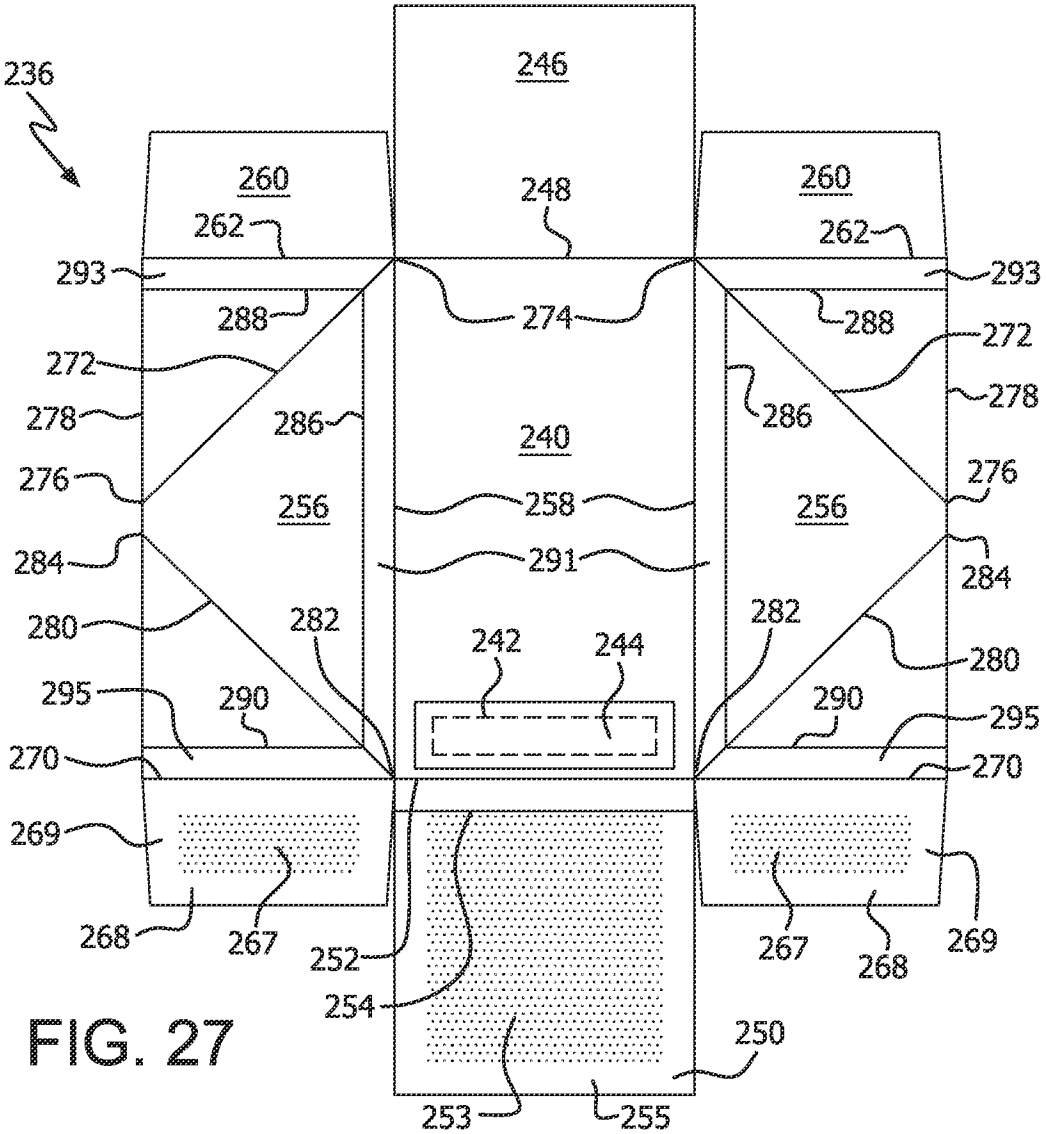
FIG. 27 is a front elevational view of a main body of FIG. 26, showing the main body flattened, and prior to attachment of the base.

Another example of the splash guard 234 is illustrated in FIGS. 26-38. Referring to FIGS. 26-28, The splash guard 234 is made from two components: a main body 236 and the base 238. The main body 236, which is illustrated in FIGS. 26-27, includes a back panel 240. The illustrated example of a back panel 240 includes a window 242 which is covered by a window covering 244 which in some examples may be paper, and which indicates the presence of urine within the splash guard 236 by changing color or by becoming visibly wet. A litmus paper, for example, will change color in the presence of an acid or base, and would thus change color in the presence of urine, which is acidic. One example of a suitable paper will change from red to dark red upon contact with urine. Any covering that produces an externally visually perceivable change when in contact with urine, and which substantially maintains the ability of the splash guard to resist urine exiting the splash guard outside the toilet may be used. A top lid panel 246 extends upward from the back panel 240, with a hinge 248 defined therebetween. A bottom panel 250 extends downward from the back panel 240, with a hinge 252 defined therebetween. In the illustrated example, and adhesive 253, which in some examples may be a pressure sensitive adhesive, is applied to the inside surface 255 of the bottom flap 250. Another hinge 254 adjacent and substantially parallel to the hinge 252 is defined within the bottom panel 250. The hinge 254 facilitates folding the splash guard 234 into a compact configuration as will be explained in greater detail below. A side panel 256 extends outward from each side of the back panel 240, with a hinge 258 defined between the back panel 240 and each side panel 256. A top flap 260 extends upward from each of the side flaps 256, with a hinge 262 defined therebetween. The illustrated example of the upper surface 264 of each top flap 260 includes an adhesive 266 thereon, which in some examples may be a pressure sensitive adhesive. A bottom flap 268 extends downward from each side panel 256, with a hinge 270 defined therebetween. In the illustrated example, and adhesive 267 is applied to the inside surface 269 of each bottom flap 268.

Each of the side panels 256 defines additional folds or hinges to facilitate folding the splash guard 234 into a compact package. Each side panel 256 defines an upper diagonal hinge 272 extending from the corner 274 to a position 276 that is proximate to the middle of the outer edge 278 of the side panel 256. In the illustrated example, the upper diagonal hinges 272 are at a substantially 45° angle from the hinge 258 as well as the hinge 262. Similarly, each side panel 256 defines a lower diagonal hinge 280, extending from the corner 282 to a position 284 that is proximate to the middle of the outer edge 278 of the side panel 256. In the illustrated example, the lower diagonal hinge 280 is at substantially a 45° angle from the hinge 258 as well as the hinge 270. A vertical side panel hinge 286 is defined within each side panel 256, adjacent to and substantially parallel to the corresponding hinge 258. Each vertical side panel hinge 286 terminates where it intersects with the upper diagonal hinge 272 and lower diagonal hinge 280. An upper side horizontal hinge 288 is defined within each side panel 256, adjacent and substantially parallel to each of the hinges 262. Each hinge 288 extends from the side edge 278 until it intersects with the upper diagonal hinge 272 at substantially the same point at which the vertical side panel hinge 286 intersects the upper diagonal hinge 272. Similarly, a lower side horizontal hinge 290 is defined within each side panel 256, adjacent and substantially parallel to each of the hinges 270. Each lower side horizontal hinge 290 extends from the side edge 278 until it intersects the lower diagonal hinge 280 at substantially the same point at which the vertical side panel hinge 286 intersects the lower diagonal hinge 280. The distance between the hinges 258, 286 is substantially the same as the distance between the hinges 262, 288, as well as the hinges 270, 290. The distance between each of these pairs of hinges is sufficient so that, when the splash guard 234 is folded as explained in greater detail below, narrow edge panels 291, 293, 295 are formed between each of these pairs of hinges to accommodate multiple layers of folded paper, paperboard, or cardboard, thus resisting any tendency for these multiple layers of paper, paperboard, or cardboard to interfere with folding the splash guard 234 into a substantially flat, easily transportable, easily stored package.

Referring to FIG. 28, the base 238 includes a central panel 292, which will form the bottom of the splash guard 234 as explained in greater detail below. An outside bowl flap 294 is secured to one side of the central panel 292, with a hinge 296 defined therebetween. An additional hinge 298 is also provided, corresponding to the hinge 254. A pressure sensitive adhesive 300 can be included on some examples of the inside face or bowl-facing surface 302 of the outside bowl flap 294. An inner bowl flap 304 is connected to the central panel 292 opposite the outside bowl flap 294, with a hinge 306 defined therebetween. Another hinge 307 is included near the end of the inner bowl flap 304 to facilitate folding the splash guard 304. A pair of bag support flaps 308 extend outward from the inner bowl flap 304, with hinges 310 defined therebetween. The illustrated examples of the bag support flaps 308 include adhesive 312 on their inside surface 314, which in some examples may be a pressure sensitive adhesive, for supporting a urine collection bag.

Figure 29:
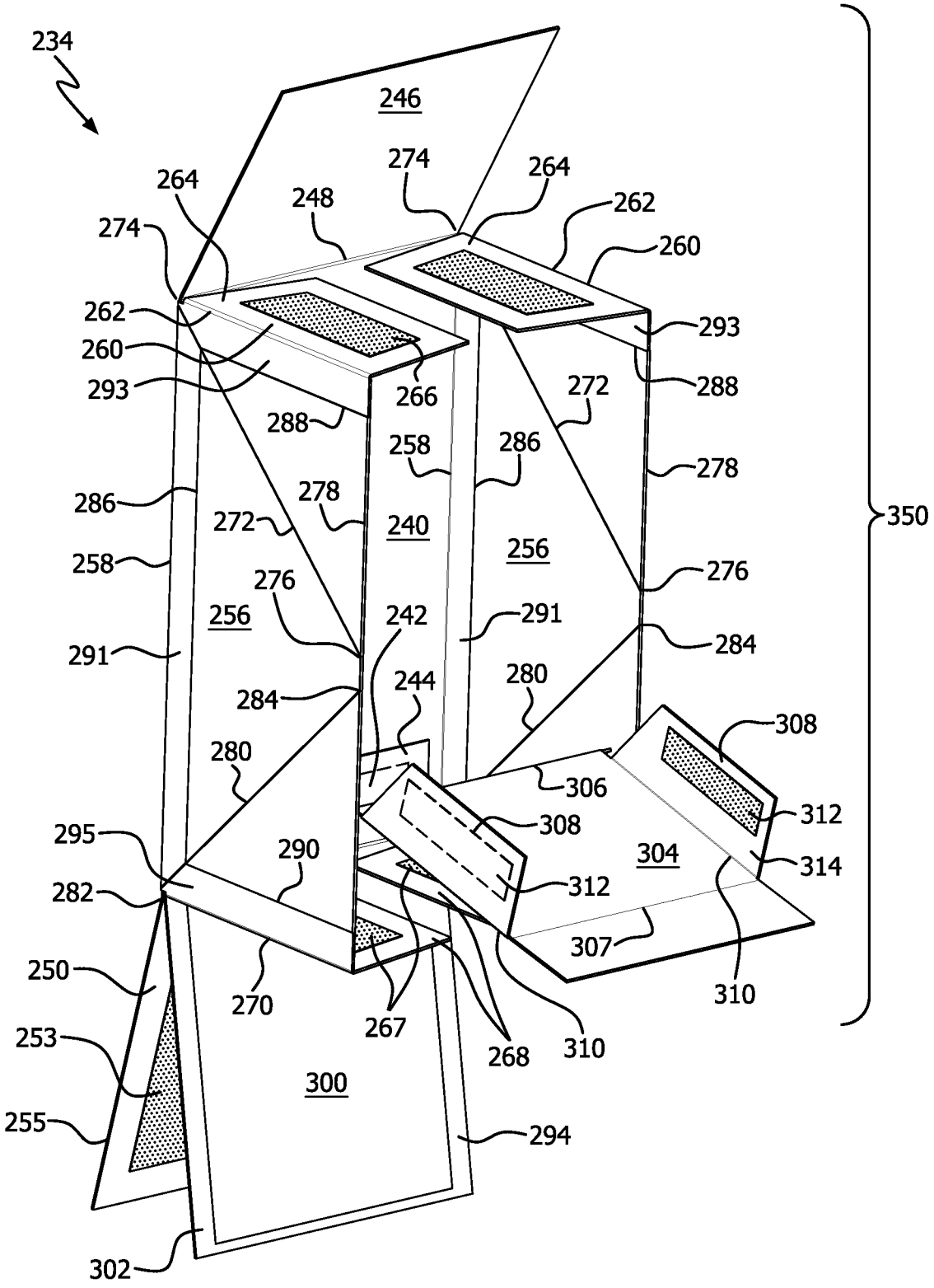
FIG. 29 is a perspective view of the main body of FIGS. 26-27 and base of FIG. 28 being assembled together.
Figure 30:
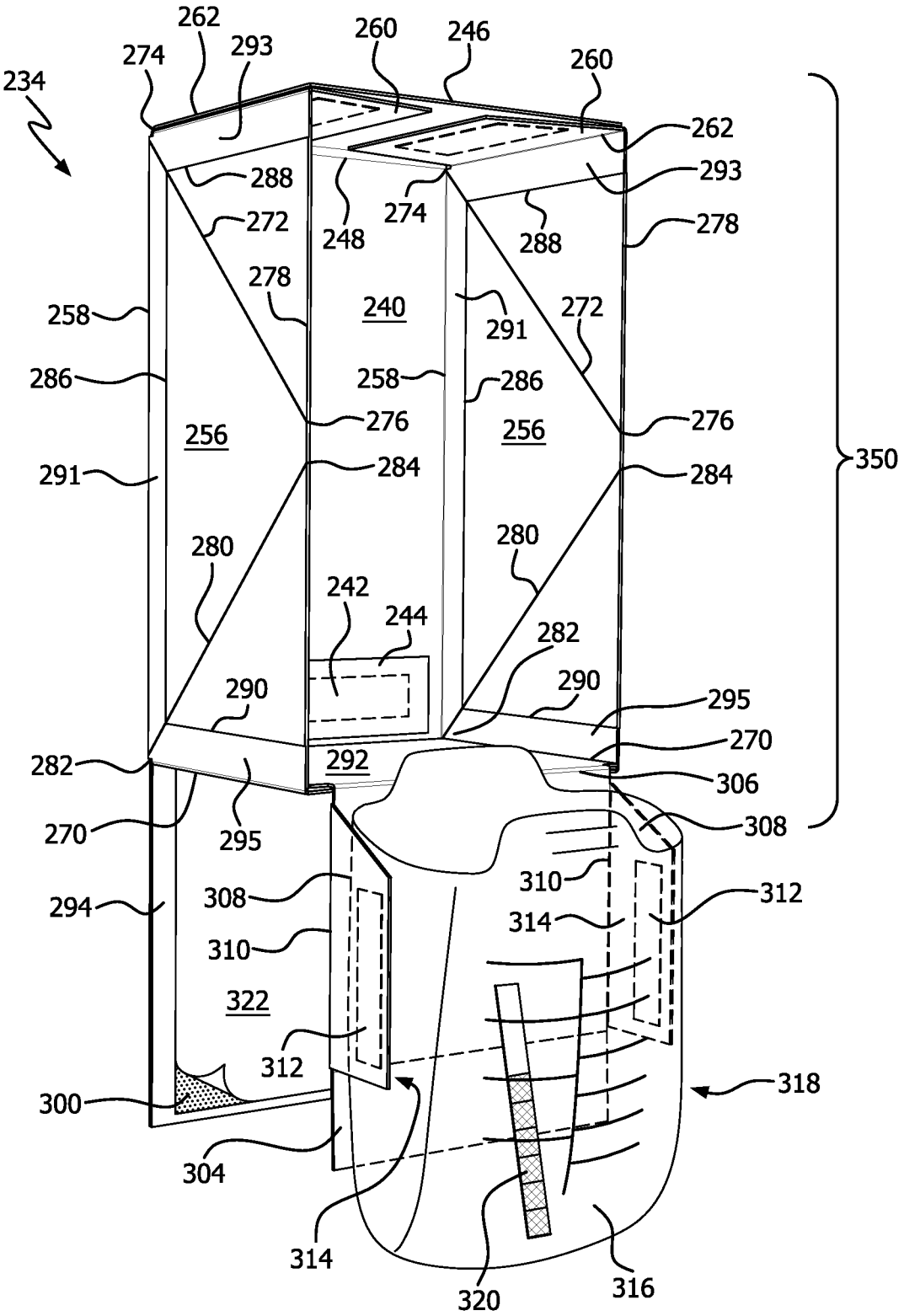
FIG. 30 is a perspective view of a splash guard made by assembling the main body of FIGS. 26-27 and base of FIG. 28, showing the splash guard configured for use.
Figure 31:
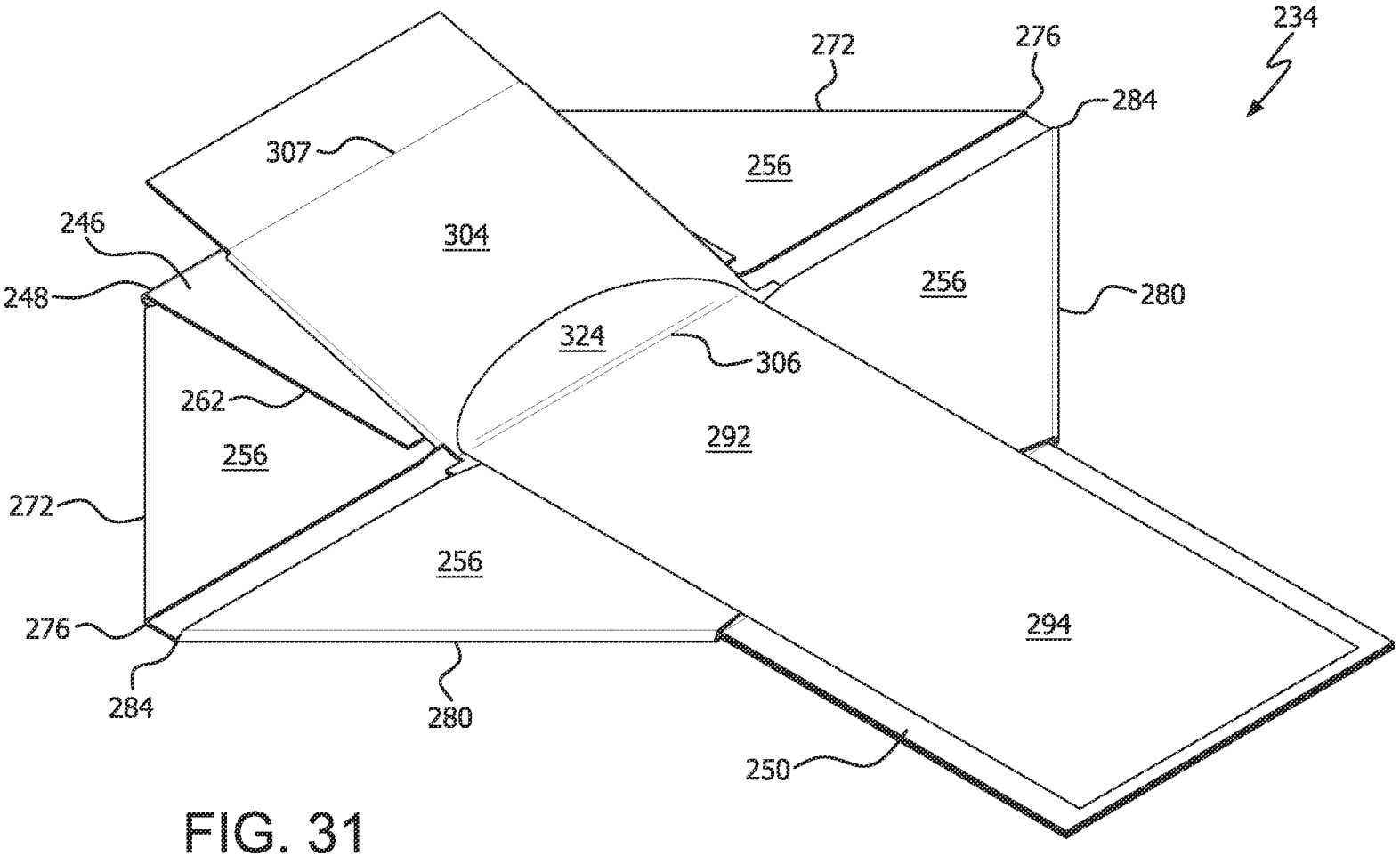
FIG. 31 is a perspective view of the splash guard of FIG. 30, showing the splash guard flattened for folding.

Assembly of the splash guard 234 is best illustrated in FIG. 29, while also referring to FIGS. 26-28. The side panels 256 are folded inward. The top flaps 260 are folded downward. The top lid panel 246 is folded downward on top of the top flaps 260, so that the adhesive 266 can be used to secure the top flaps 260 to the top lid panel 246. The bottom flaps 268 are folded upward. The side of the outside bowl flap 294 of the base 238, opposite the adhesive 300, is secured to the bottom panel 250 using the adhesive 253. The central panel 292 of the base 238 is positioned above the bottom flaps 268. The bottom flaps 268 are secured to the bottom surface of the central panel 292 using the adhesive 267. The shield portion 350 is formed at this point. The inner bowl flap 304 is folded downward. Referring to FIG. 30, a urine collection bag 316 may be secured to the adhesive 312 of the bag support flaps 308. The illustrated example of the urine collection bag 316 includes indicia 318 for measuring the amount of urine contained therein. A test strip 320 is illustrated within the urine collection bag 316, and in some examples may be adhered to or otherwise attached to the splash guard 234 or bag 316. The test strip 320 can be part of the urine collection bag 316, or can be a completely separate test strip 320. The test strip 320 can be used to check for urinary tract infections as well as for testing for drugs. Referring briefly to FIG. 31, an optional pull tab 324 is provided to facilitate unfolding the splash guard 234 as described in greater detail below. In the illustrated example, the pull tab 324 is adjacent to the hinge 306.

With the splash guard 234 in the configuration shown in FIG. 30, it may be placed over a toilet seat 42, with the outer bowl flap 294 outside of the seat, and the inner bowl flap 304 inside the seat. Some examples of the splash guard 234 may be held in position by the user's legs. Additionally, the pressure sensitive adhesive 300, which is covered by a protective paper 322, can be used to secure the splash guard 234 to a toilet bowl by removing the protective paper 322, and pressing the outer bowl flap 294 against the bowl 46.

Figure 32:
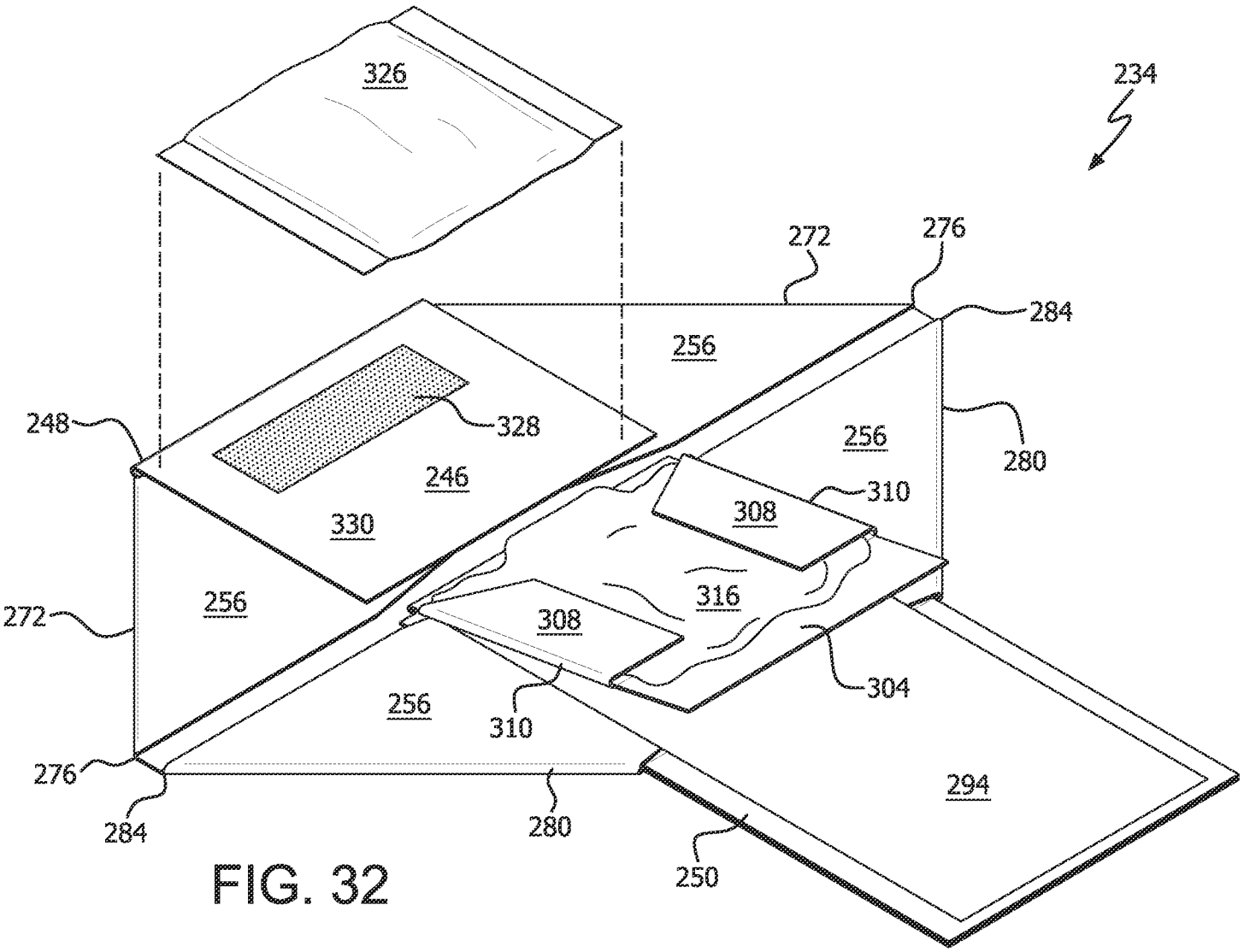
FIG. 32 is a perspective view of the splash guard of FIG. 30, showing the attachment of a packaged cleaning wipe to the splash guard.
Figure 33:
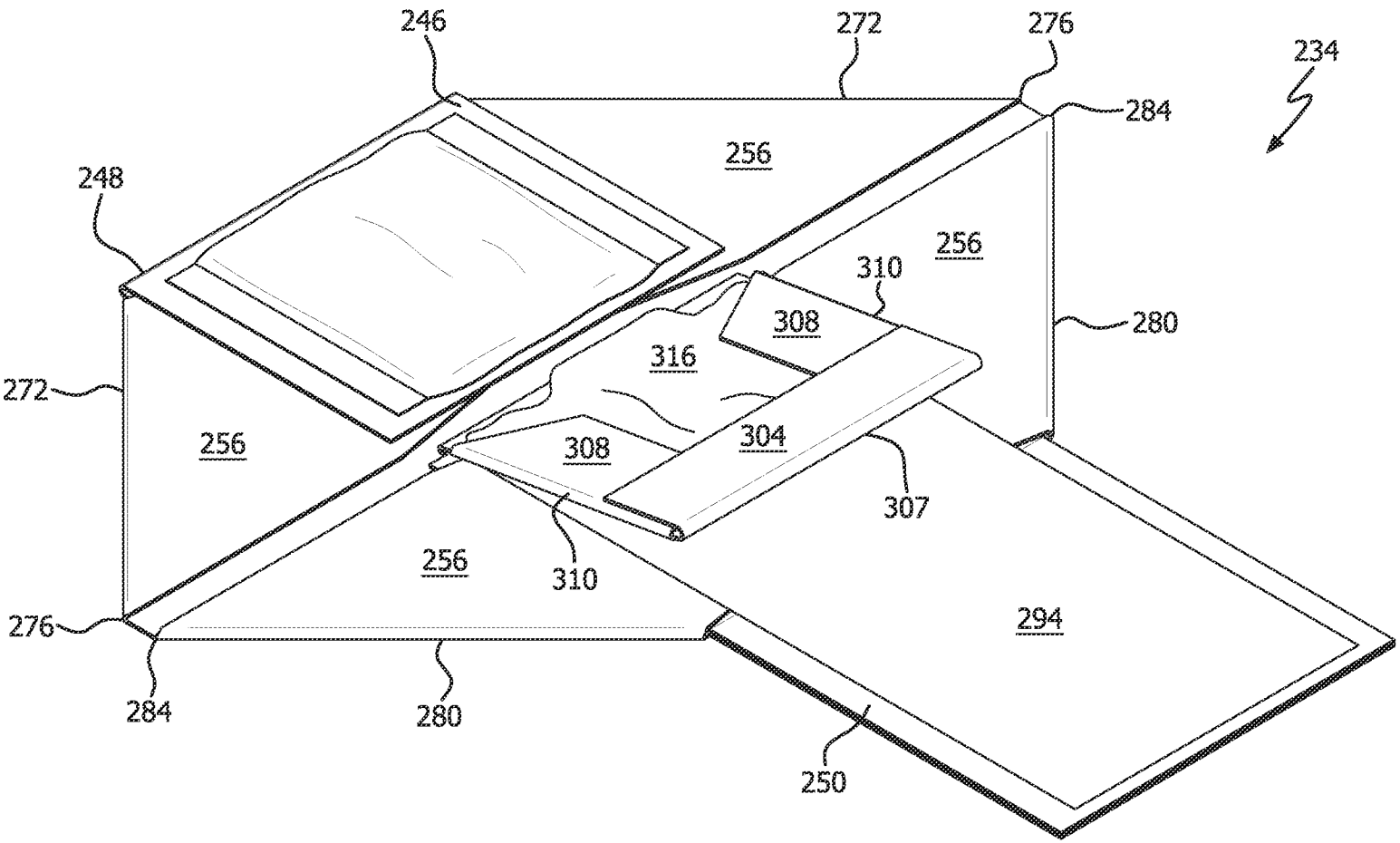
FIG. 33 is a perspective view of the splash guard of FIG. 30, showing the packaged cleaning wipe attached, and the splash guard flattened for folding.
Figure 34:
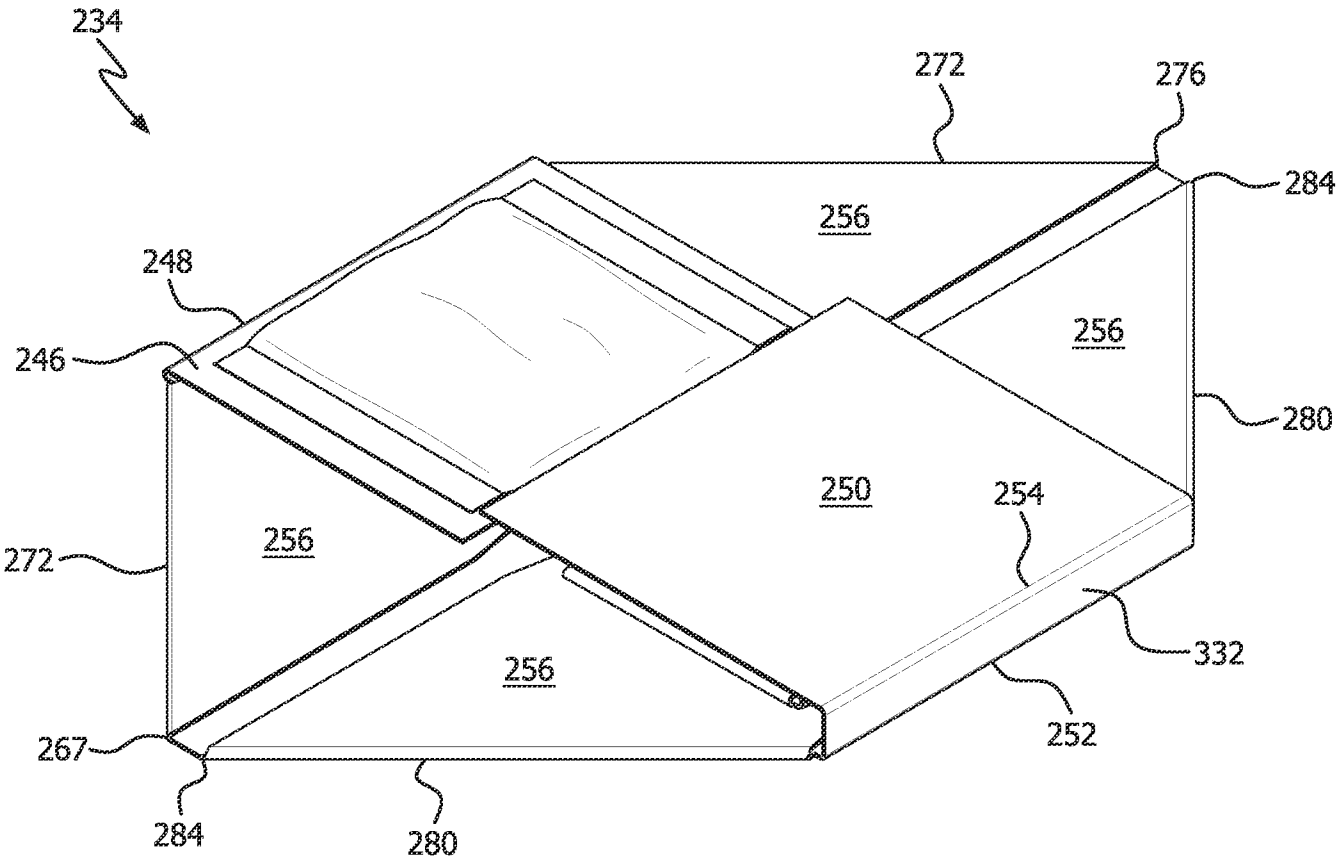
FIG. 34 is a perspective view of the splash guard of FIG. 30 showing the splash guard flattened and the bottom portion of the splash guard folded upward.
Figure 35:
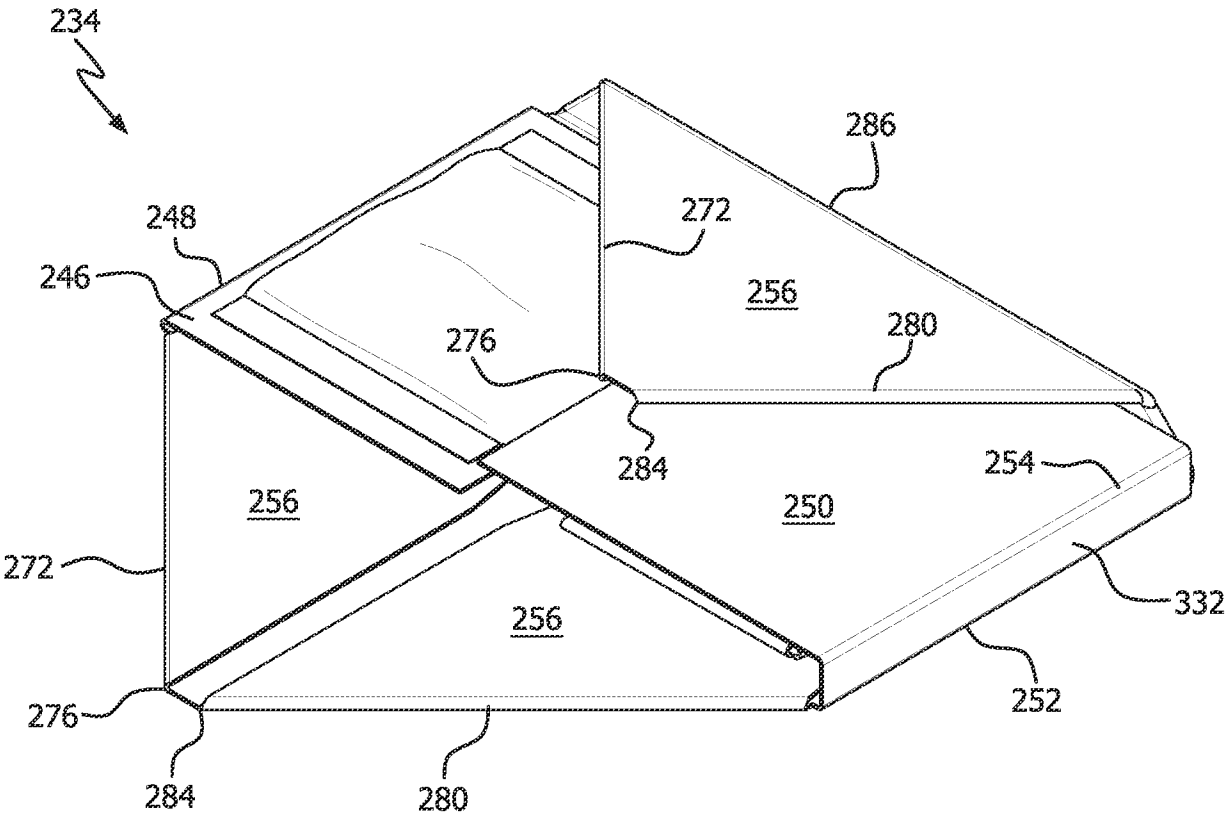
FIG. 35 is a perspective view of the splash guard of FIG. 30, showing the splash guard flattened, the bottom portion of the splash guard folded upward, and one side folded inward.
Figure 36:
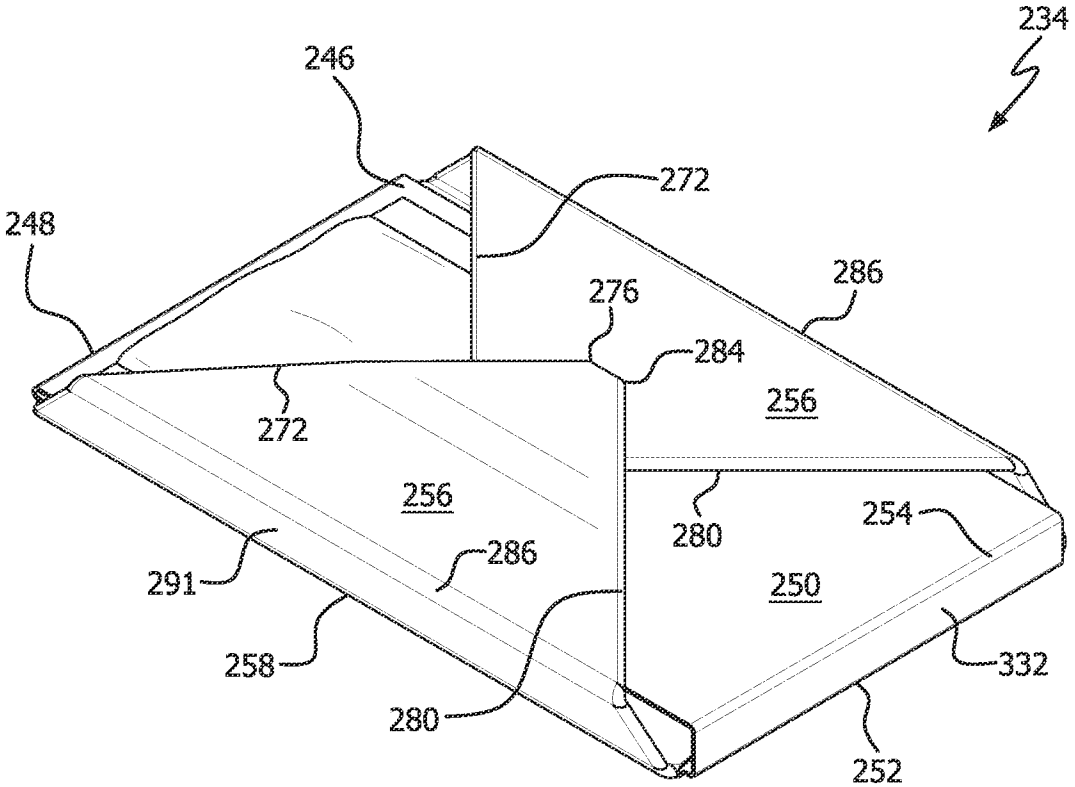
FIG. 36 is a perspective view of the splash guard of FIG. 30, showing the splash guard flattened, the bottom portion of the splash guard folded upward, and both sides folded inward.

The process of folding the splash guard 234 for storage and transportation is best illustrated in FIGS. 31-38. It is anticipated that the splash guard 234 will be assembled and folded as part of the manufacturing process, supplied to the end user in a folded configuration, and then unfolded for use. As shown in FIGS. 31-33, the splash guard 232 is first folded along the fold lines 272, 248 to collapse the top panel 246 against the back panel 240. Next, the splash guard 234 is folded along the fold lines 280, 252 to collapse the center panel 292 of the base 238 against the back panel 240. FIGS. 32-33 illustrates an optional prepackaged wet wipe, shown within the package 326, that can be packaged with some examples of the splash guard 324. In the illustrated example, and adhesive 328, which in some examples may be a pressure sensitive adhesive, has been applied to the upper surface 330 of the top panel 246. The package 326 for the wet wipe is then adhered to the adhesive 328. The inside bowl flap 304 is folded along the fold 307. The outside bowl flap 294 is then folded upward along the hinges 252, 254 as shown in FIG. 34. The edge panel 332 defined between the hinges 252, 254 provides space between the back panel 240 and outside 250 for other parts of the splash guard 234 to be contained therein. One of the side panels 256 is then folded inward as illustrated in FIG. 35, followed by the other side panel 256 as illustrated in FIG. 36. The edge panels 291 provides space for other panels to be contained between the side panels 256 and the back panel 240. The splash guard 234 can then be secured in this configuration, for example, by the adhesive sticker 334. The splash guard 234 may be individually bagged, for example, in cellophane bags, for maximized hygiene.

Figure 38:
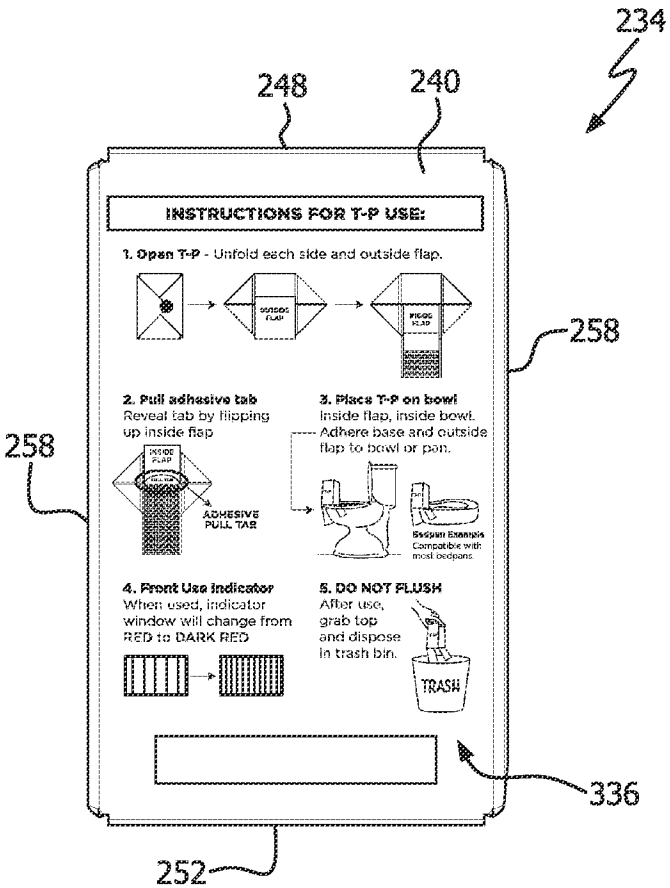
FIG. 38 is a back elevational view of the splash guard of FIG. 30 in its folded configuration.
Figure 37:
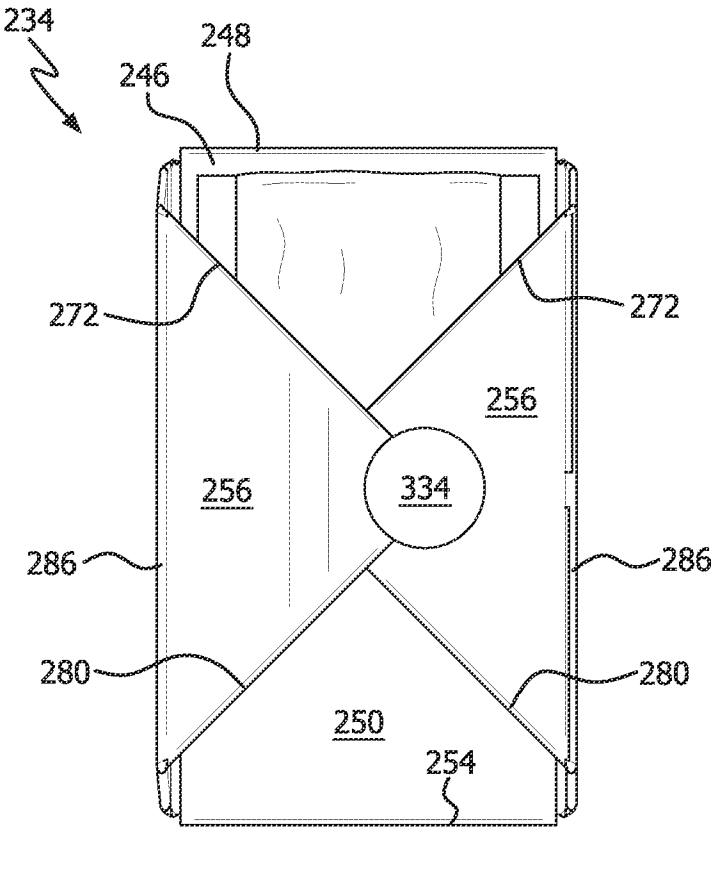
FIG. 37 is a front elevational view of the splash guard of FIG. 30, showing the splash guard secured in a fully folded configuration.
Figure 39:
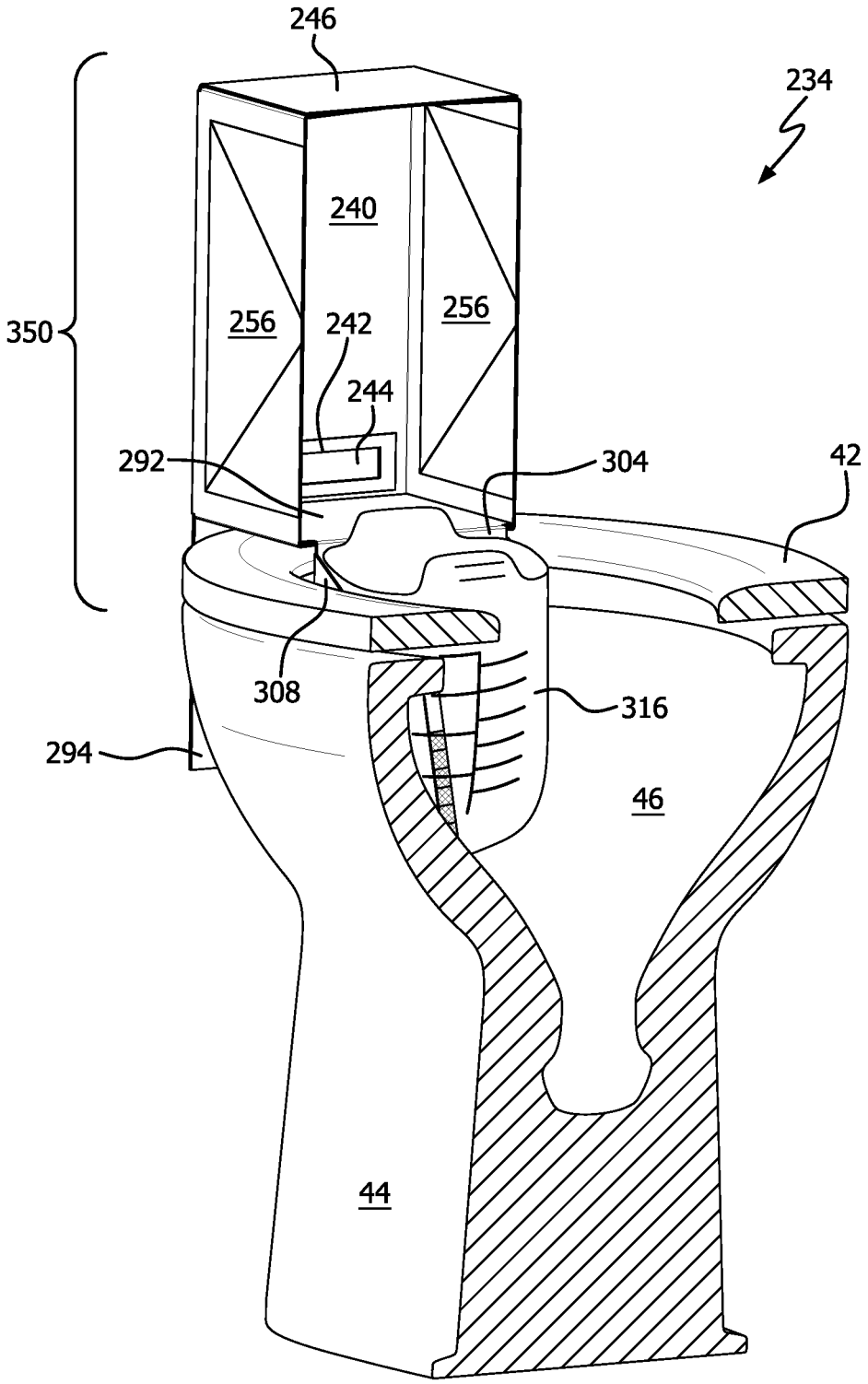
FIG. 39 is an environmental, perspective view of a splash guard made by assembling the main body of FIGS. 26-27 and base of FIG. 28

When use of a splash guard 234 is desired, is unfolded in the reverse of the procedure described above. Instructions for unfolding and using the splash guard can be provided on the back surface 336 of the back panel 240, as illustrated in FIG. 38. The splash guard 234 can then be placed on the seat 42 of a toilet 44 as shown in FIG. 39, and held between the user's legs and/or adhered to the bowl 44 using the adhesive 300. If the window 242 is present, an assistant may see whether urination has occurred. If urine collection is desired, urine may be collected, and the quantity of urine measured, utilizing the bag 316. If desired, the urine may be tested using the test strip 324 the presence of a urinary tract infection or the presence of alcohol or drugs. Otherwise, urine may simply fall from the splash guard 234 into the bowl 46 of the toilet 44. Once urination is complete and any necessary urine collection has taken place, the splash guard 234 can be discarded.

Some examples of the splash guard 234 may include a QR code printed thereon. When the splash guard 234 is utilized, the user or an attendant may scan the QR code using their smart phone or other similar device. The QR code can link a website wherein the user's urination information is stored. The time of urination, amount of urine, and/or any test results can then be entered. The time of urination may be automatically entered as the time the QR code is scanned.

The above illustrated examples of the seat protector are examples only, and do not show every possible permutation of the invention. To illustrate some possible modifications, any top panel combination, side panel combination, seat flap combination, or bowl flap combination shown in any of these examples can be used with any of the other examples. Furthermore, the specific shape of each of these components can be modified to better conform to various types of toilet seats. Although the illustrated examples utilize the back panel as the central panel to which the top and side panels are connected, other examples may utilize side panels that are hingedly connected to the top panel. Although some illustrated examples illustrate the seat guard extending downward from the seat flap, the seat guard could be hingedly connected to either side panel. Similarly, the seat flap could be connected to either of the downwardly extending arms instead of to the back panel. As another alternative, any version of the splash guard may be secured together using either a releasable adhesive or a combination of tabs and slots.

The present invention therefore provides a toilet splash guard which can be carried in a flattened and/or folded configuration, and which can then be easily placed on a toilet seat for use. The splash guard can be discarded after use, avoiding any necessity of cleaning the splash guard. Some examples of the splash guard are water degradable, and can be flushed down a toilet after use. Other examples may include a window to ensure that urination has occurred. Some examples of the splash guard may include a bag for measuring the amount of urine discharged, and/or to facilitate testing the urine. The splash guard can be utilized by children and adults with disabilities, people who have suffered injuries, the elderly, those assisting such individuals, hospitals, long-term care facilities, therapy centers, etc.

Although the invention has been described as a toilet splash guard, the inventors have found that the invention can also be utilized with bed pan. A splash guard intended for use with a bed pan may be modified in a manner that supports use with a bed pan. For example, the inner and outer bowl flaps may be closer together to fit more closely over the sides of a bed pan. As another example, the adhesive used to secure the splash guard to a toilet bowl may be placed on a different panel or panels in order to better secure the splash guard to a bed pan. For example, the adhesive may be placed on a bed pan facing surface of the inner bowl flap, and the length of the inner bowl flap and outer bowl flap may be predetermined to correspond to the height of a bed pan, so that the bottom edge of the outer flap may rest on a mattress during use.

A variety of modifications to the above-described embodiments will be apparent to those skilled in the art from this disclosure. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. A splash guard, comprising:

a shield portion having a back panel, a top panel, and a pair of side panels, each panel being hingedly attached to at least one other panel;

the splash guard being foldable into a flattened configuration and into a use configuration;

a seat flap foldably connected to one of the back panel and side panels, the seat flap fitting between a toilet seat and a toilet bowl when the splash guard is positioned on the toilet seat; and the splash guard being made from paper, cardboard, corn starch, a polymer, a paper or cardboard having a polymer or lacquer coating, or a combination thereof.

2. A splash guard, comprising:

a shield portion having a back panel, a top panel, and a pair of side panels, each panel being hingedly attached to at least one other panel;

the splash guard being foldable into a flattened configuration and into a use configuration;

a pair of arms, each of the arms depending downward from one of the side panels, the arms abutting an inner edge of a toilet seat when the splash guard is positioned on a toilet seat; and the splash guard being made from paper, cardboard, corn starch, a polymer, a paper or cardboard having a polymer or lacquer coating, or a combination thereof.

3. The splash guard according to claim 2, wherein the arms define at least one hook, the hook abutting a lower surface of the toilet seat when the splash guard is positioned on a toilet seat.

4. A splash guard, comprising:

a shield portion having a back panel, a top panel, and a pair of side panels, each panel being hingedly attached to at least one other panel;

the splash guard being foldable into a flattened configuration and into a use configuration; and a seat flap foldably connected to one of the back panel and side panels, the seat flap fitting between a toilet seat and a toilet bowl when the splash guard is positioned on the toilet seat.

5. A splash guard, comprising:

a shield portion having a back panel, a top panel, and a pair of side panels, each panel being hingedly attached to at least one other panel;

the splash guard being foldable into a flattened configuration and into a use configuration; and a pair of arms, each of the arms depending downward from one of the side panels, the arms abutting an inner edge of a toilet seat when the splash guard is positioned on a toilet seat.

6. The splash guard according to claim 5, wherein the arms define at least one hook, the hook abutting a lower surface of the toilet seat when the splash guard is positioned on a toilet seat.

7. A splash guard comprising:

a shield portion having a back panel, a top panel, and a pair of side panels, each panel being hingedly attached to at least one other panel, and a bottom panel, with fold lines being defined between the bottom panel, a bottom edge of each side panel, a bottom edge of the back panel, between an edge of the top panel and a top edge of the back panel, and between an edge of each side panel and a side edge of one of the back panel;

an outer bowl flap depending downward from the bottom panel, and an inner bowl flap depending downward from the bottom panel; and the splash guard being foldable into a flattened configuration and into a use configuration.

8. The splash guard according to claim 7, wherein the outer bowl flap is adjacent to the back panel, and the inner bowl flap is adjacent to an edge of the bottom panel opposite the back panel.

9. The splash guard according to claim 7, wherein at least one of the outer bowl flap and the inner bowl flap includes a bowl-facing surface, the bowl-facing surface having an adhesive thereon, the adhesive being structured to temporarily adhere the outer bowl flap to a toilet bowl.

10. The splash guard according to claim 7, wherein each of the side panels define diagonal fold lines therewithin, whereby the top panel of the shield portion and bottom panel of the shield portion may be folded inward towards the back panel.

11. The splash guard according to claim 10, wherein each of the diagonal fold lines extends from an intersection of one of the side panels, the back panel, and one of the top panel or the bottom panel, and a middle portion of an edge of one of the side panels opposite the back panel.

12. The splash guard according to claim 10, wherein each of the side panels defines:

a vertical fold line adjacent to and substantially parallel to each fold line defined between one of the side panels and the back panel;

a horizontal fold line adjacent to and substantially parallel to each fold line defined between one of the side panels and the top panel; and a horizontal fold line adjacent to and substantially parallel to each fold line defined between one of the side panels and the bottom panel.

13. The splash guard according to claim 7, further comprising a pair of bag support flaps extending from opposing sides of the inner bowl flap.

14. The splash guard according to claim 13, further comprising a bag secured adjacent to the inner bowl flap.

15. A splash guard, comprising:

a shield portion having a back panel, a top panel, and a pair of side panels, each panel being hingedly attached to at least one other panel;

the splash guard being foldable into a flattened configuration and into a use configuration; and a window defined within the back panel, the window having a covering, the covering undergoing an externally visually perceivable change upon contact with urine.

* * * * *